US006678933B2

(12) United States Patent
Arvin

(10) Patent No.: US 6,678,933 B2
(45) Date of Patent: Jan. 20, 2004

(54) PLUMBING WORKSTATION

(75) Inventor: Jerome M. Arvin, Springville, IN (US)

(73) Assignee: Plumbing 2000, Inc., Springville, IN (US)

( * ) Notice: Subject to any disclaimer, the term of this patent is extended or adjusted under 35 U.S.C. 154(b) by 0 days.

(21) Appl. No.: 10/301,954

(22) Filed: Nov. 22, 2002

(65) Prior Publication Data

US 2003/0121136 A1 Jul. 3, 2003

Related U.S. Application Data

(63) Continuation-in-part of application No. 09/522,518, filed on Mar. 10, 2000, now Pat. No. 6,484,378.

(51) Int. Cl.[7] ..... B25B 27/14

(52) U.S. Cl. ..... 29/281.5; 29/281.1; 269/71; 269/289 R

(58) Field of Search ..... 29/281.5, 281.1, 29/559, 355, 535; 269/289 R, 71, 73, 69, 68, 296, 285, 6, 3

(56) References Cited

U.S. PATENT DOCUMENTS

| | | | | |
|---|---|---|---|---|
| 98,361 A | | 12/1869 | Ellis | |
| 424,879 A | | 4/1890 | Golder | |
| 1,902,424 A | | 3/1933 | Sherman | |
| 2,904,087 A | | 9/1959 | Walthall | |
| 3,086,767 A | | 4/1963 | Boser | |
| 3,643,935 A | | 2/1972 | Bell | |
| 4,943,040 A | | 7/1990 | Finstad | |
| 5,082,038 A | | 1/1992 | Teel | |
| 5,191,821 A | * | 3/1993 | Metzger, Jr. et al. | 269/6 |
| 5,494,553 A | * | 2/1996 | Colucci | 269/6 |
| 6,412,158 B1 | * | 7/2002 | Moore | 29/249 |
| 6,484,378 B1 | * | 11/2002 | Arvin | 29/281.5 |

* cited by examiner

*Primary Examiner*—Lee D. Wilson
(74) *Attorney, Agent, or Firm*—Jay G. Taylor; Michael A. Swift; Ice Miller

(57) ABSTRACT

An improved plumbing workstation for use by a worker to install at least one plumbing fixture onto at least one sink, comprising a template for temporarily supporting the at least one sink, the template being adjustable to accommodate at least one size and at least one shape of the at least one sink, a frame upon which the template is mounted for 360° rotation about a horizontal axis, at least one mechanism for locking the template at selected angular positions about the horizontal axis, and retaining mechanism for retaining the at least one sink on the template and for retaining at least one sink a drain attachment on the at least one sink such that when the at least one sink is secured on the template, the template is at a generally horizontal first angular position, and when the template is rotated about the horizontal axis from the first angular position to a second angular position, the at least one sink is retained on the template to facilitate installation of the at lease one plumbing fixture and the at least one sink drain attachment on the at least one sink.

20 Claims, 23 Drawing Sheets

PLUMBING WORKSTATION

This application is a continuation-in-part of application Ser. No. 09/522,518, filed on Mar. 10, 2000 now U.S. Pat. No. 6,484,378.

BACKGROUND

This invention relates to portable work stands in particular to a plumbing workstation having a plurality of interchangeable pivotal support templates. The templates are suitable for receiving specified sinks for installation of plumbing fixtures or suitable for assembling multiple tub/shower valve assemblies.

The traditional method of installing a sink is to first place the sink into the counter top opening, then proceed to attach various fixtures such as faucets, basket strainers, spray hose, garbage disposals and supply lines. Of course, the number and type of fixtures depends on the type of sink being installed. To do this, the installer must manipulate his body under the counter top, usually inside the cabinet or on the floor in an awkward position, holding fixture with one hand and using the other to operate hand tools. This is a time consuming process and one which often can lead to back strain because of the awkward position that the plumber must assume when installing plumbing fixtures on the sink in this traditional manner. Lost time injuries resulting from the traditional method of installing sinks are common and costly to the plumbing industry.

In the case of tub/shower valve assemblies, a plumber traditionally assembles each unit on the floor of the job site or on a workbench at the job site. The shower head pipe is typically inserted into the tub/shower valve. The plumber must arrange the tub/shower valve and shower head pipe to ensure that the head pipe is perpendicular to the tub/shower valve prior to soldering. This can be tricky because the shower head pipe is several feet long. Once the head pipe has been soldered in place, the plumber must wait until the solder joint has cooled enough to establish a viable connection before attempting to solder the shorter tub head pipe. The procedure is relatively time consuming as only one tub/shower valve assembly can be constructed at a time. Further, the tub/shower valve—shower head pipe joint frequently leaks and/or the shower head pipe is not essentially perpendicular, which can create installation problems and typically requires resoldering of the joint.

The deficiencies of the traditional approach to trimming-out and installing sinks and tub/shower valve assemblies are magnified in the case of multiple unit structures such as hotels and apartment buildings. Instead of two or three sinks and tub/shower valve assemblies as in a typically single family dwelling, the hotel or apartment building presents the plumber with up to hundreds of sinks and tub/shower valves to be trimmed out and installed. The likelihood of back strain and lost time injury increases dramatically. Further, the inefficiencies of the process are magnified. Every extra minute taken to assemble sinks or tub/shower valve assemblies on big projects is money out of the plumber's pocket as those types of jobs are typically bid on a fixed costs basis. Stated differently, the plumber gets paid a set fee for the job no matter how long it takes to complete.

Thus, the traditional approach to trimming-out sinks and tub/shower valve assemblies is inefficient, time consuming and, therefore, costly. Trimming-out sinks is awkward and frequently results in back strain and lost time injuries. Therefore, there is a desperate need in the plumbing industry for a device and method that will overcome the deficiencies associated with the traditional approach to assembling sinks and tub/shower valve assemblies. This is especially true for plumbing jobs involving multiple unit facilities such as hotels and apartment buildings.

SUMMARY

In accordance with the present invention, a plumbing workstation is provided which solves the deficiencies inherent in traditional approaches to trimming-out sinks and tub/shower valves. The plumbing workstation reduces the time and therefore cost associated with assembling tub/shower assemblies and installing plumbing fixtures such as faucets, pop-up assemblies, spray assemblies, garbage disposals, drain assemblies and basket strainers onto sinks prior to installation of the sinks into counter tops in kitchens, bathrooms and bars. The invention is particularly effective in reducing time and cost in the case of multiple unit facilities such as hotels and apartment buildings. Additionally, the plumbing workstation allows the worker to install the plumbing fixtures from an upright comfortable position thereby eliminating back strain and other muscle strains common to the traditional method of installing plumbing fixtures on a sink.

In accordance with the present invention, the plumbing workstation includes a frame and a means for supporting a sink. The supporting means is carried on the frame for rotation about a horizontal axis. The plumbing workstation further includes a means for locking the supporting means relative to the frame at selected angular positions about the horizontal axis. A means for securing the sink on the supporting means is provided such that when the sink is secured on the supporting means, the supporting means is a first angular position and when the supporting means is rotated about the horizontal axis from the first angular position to a second angular position, the sink is retained on the supporting means to facilitate installation of plumbing fixtures on the sink. The supporting means is carried on the frame and is rotatable over 360 degrees about the horizontal axis.

The plumbing workstation further comprises a second supporting means. The second supporting means is interchangeable with the supporting means for installation on the frame and is pivotally carried on the frame for rotation about the horizontal axis. The second supporting means is arranged and constructed to support more than one sink.

The plumbing workstation further comprises a third supporting means that is interchangeable with the supporting means for installation on the frame. The third supporting means is pivotally carried on the frame for rotation about the horizontal axis. The third supporting means having means for mounting one or more tub/shower valves such that a worker can assemble one or more tub/shower valve assemblies.

The plumbing workstation further comprising means for retaining sink drain attachments. The sink drain attachment retaining means is mounted on the supporting means such that when the supporting means is rotated to the second angular position, the sink drain attachment retaining means holds sink drain attachments in place while the worker applies pressure to install the sink drain attachments. If the second supporting means is being utilized, then the plumbing workstation further comprises more than one sink drain attachment retaining means. The more than one sink drain attachment retaining means is mounted on the second supporting means such that when the second supporting means is rotated to the second angular position, the more than one sink drain attachment retaining means holds sink drain attachments in place on more than one sink while the worker applies pressure to install the sink drain attachments on the more than one sink.

The plumbing workstation further comprising a frame that includes means for vertically adjusting the position of the horizontal axis so that the horizontal axis can be adjusted by the worker to a height such that the worker can comfortably install plumbing fixtures. The frame may further comprise means for collapsing the frame thereby allowing the plumbing workstation to be easily transported and stored.

According to another embodiment of the present invention, a method for installing plumbing fixtures on a sink using a plumbing workstation comprises the steps of: choosing a template such that the template chosen is suitable for supporting a first sink to be worked on; installing the template onto a frame; locking the template into a horizontal position on the frame; placing the first sink into the template; securing the first sink into the template; temporarily retaining the plumbing fixtures onto the sink; rotating the template about a horizontal axis into a comfortable working position; locking the template into the comfortable working position; and installing a plumbing fixture onto the first sink.

According to another embodiment of the present invention, a method for installing plumbing fixtures on multiple sinks using a plumbing workstation comprises the steps: choosing a template such that the template chosen is suitable for supporting more than one sink to be worked on; installing the template onto a frame; locking the template into a horizontal position on the frame; placing the more than one sink into the template; securing the more than one sink into the template; rotating the template about a horizontal axis into a comfortable working position; locking the template into the comfortable working position; installing plumbing fixtures onto the more than one sink; rotating the template back to the horizontal position; locking the template into the horizontal position; unsecuring the more than one sink from the template; and removing the fully assembled more than one sink from the template.

According to yet another embodiment of the present invention, a method of using a plumbing workstation to assemble tub/shower valve assemblies comprises the steps: choosing a template such that the template chosen is suitable for assembling one or more tub/shower valve assemblies; installing the template onto a frame; locking the template into a horizontal position on the frame; mounting one or more tub/shower valves onto the template; inserting shower head pipes into the one or more tub/shower valves; inserting tub head pipes into the one or more tub/shower valves; soldering the showering head pipes and tub head pipes into the one or more tub/shower valves to complete assembly of the one or more tub/shower valve assemblies; and removing the one or more tub/shower valve assemblies from the template.

Use of the present invention results in significant reduction of trim-out time resulting in a corresponding cost savings. The invention is particularly suitable for large plumbing jobs involving multiple units, for example, hotels and apartment buildings. Additionally, the present invention eliminates uncomfortable body positions during the installation of various plumbing fixtures, thereby eliminating muscle strains, back problems, and associated lost productivity and time off.

These and other advantages and features of the present invention shall hereinafter appear, and for the purposes of illustration, but not limitation, exemplary embodiments of the present invention shall hereinafter be described.

BRIEF DESCRIPTION OF THE DRAWINGS

FIG. 16A is an the exploded view of an alternate embodiment of a sink retainer.

FIG. 17A is an exploded view of the alternate frame's height adjustment feature.

DETAILED DESCRIPTION

Structure

Figure 1:
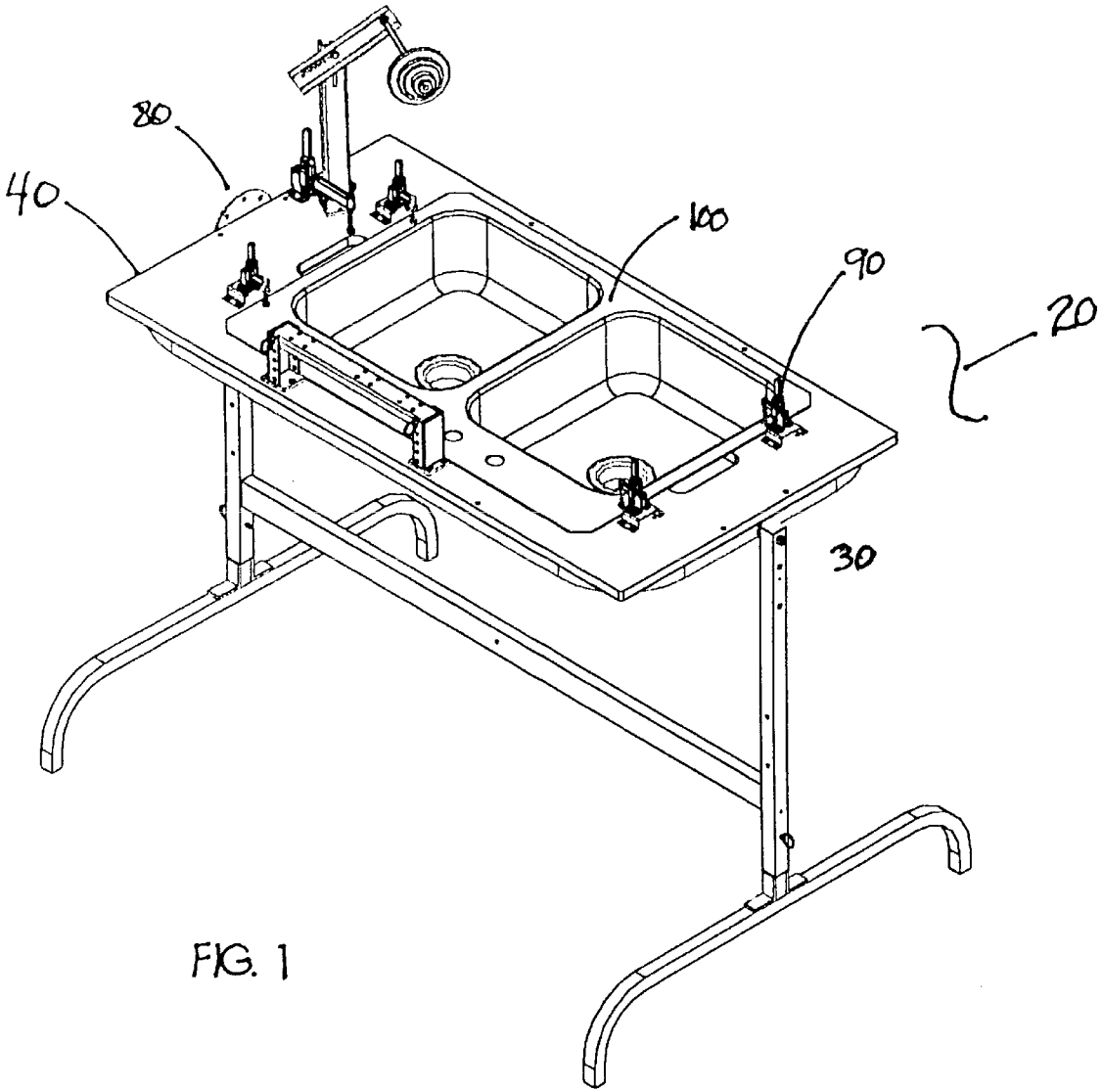
FIG. 1 is a perspective view of the plumbing workstation with an unibody double sink installed on the template.
Figure 2:
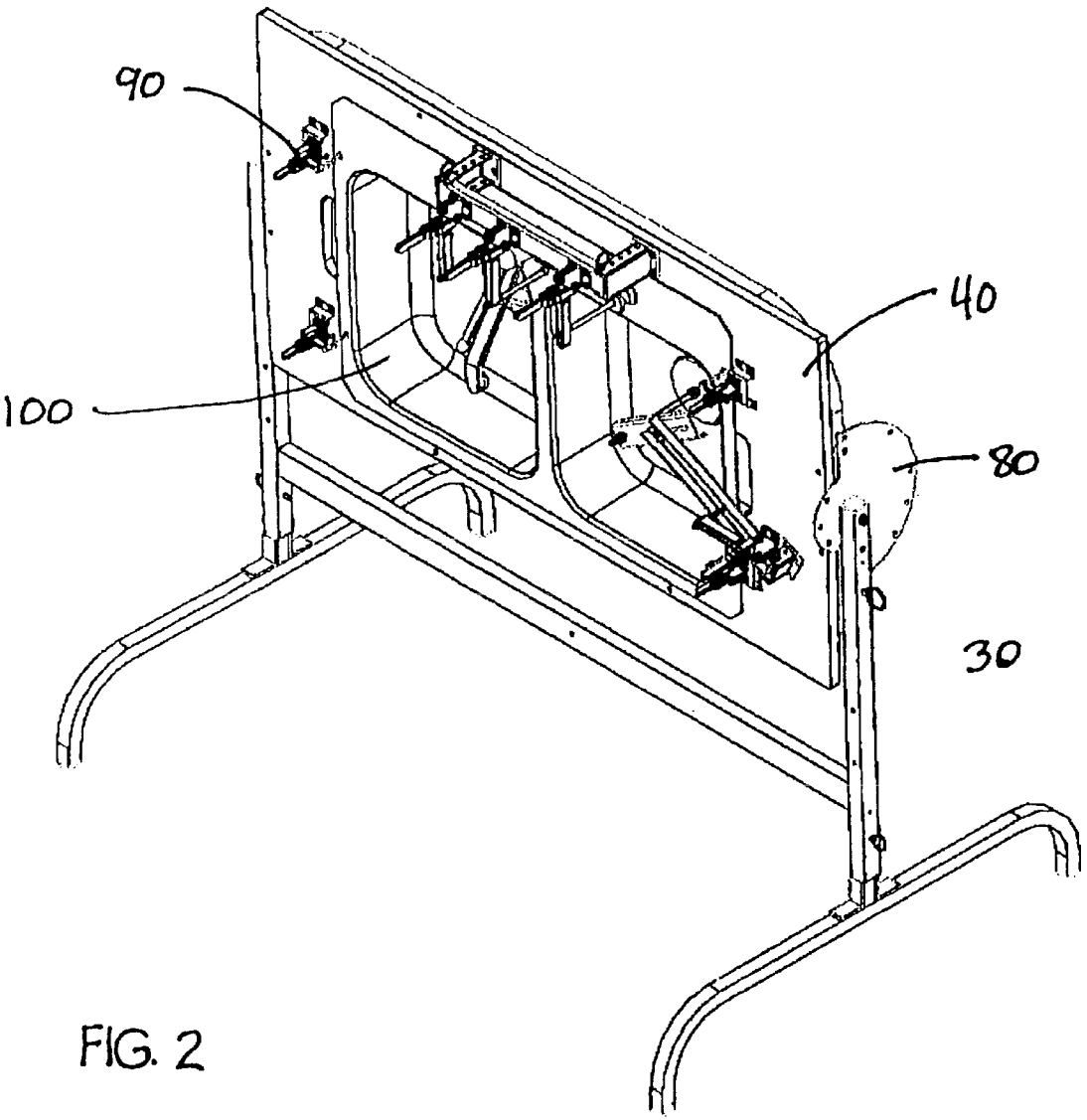
FIG. 2 is a perspective view of the plumbing workstation of FIG. 1 wherein the template is rotated 90 degrees about the horizontal axis.

In accordance with the present invention, a plumbing trim-out workstation is provided as shown in FIG. 1, FIG. 2, FIG. 3 and FIG. 10 and is generally indicated by the numeral 20. The plumbing trim-out workstation 20 includes a frame 30, and interchangeable template 40 for supporting a sink unit 100 that is pivotally carried on the frame 30 and is rotatable 360 degree about a horizontal axis 70 relative to the frame 30 (See FIG. 4.), a releaseable lock 80 mounted to the frame 30 for locking the template 40, 50, 60 relative to the frame 30 at selected angular positions about the horizontal axis 70, and at least one sink retainer 90 for securing a sink or multiple sinks on the template such that when the sink is on the template and secured by the sink retainer, the sink will be retained on the template as the template is rotated about the horizontal axis 70. A template 40, 50, 55, 60 when mounted on frame 30 is rotatable over 360° about the horizontal axis 70.

Figure 3:
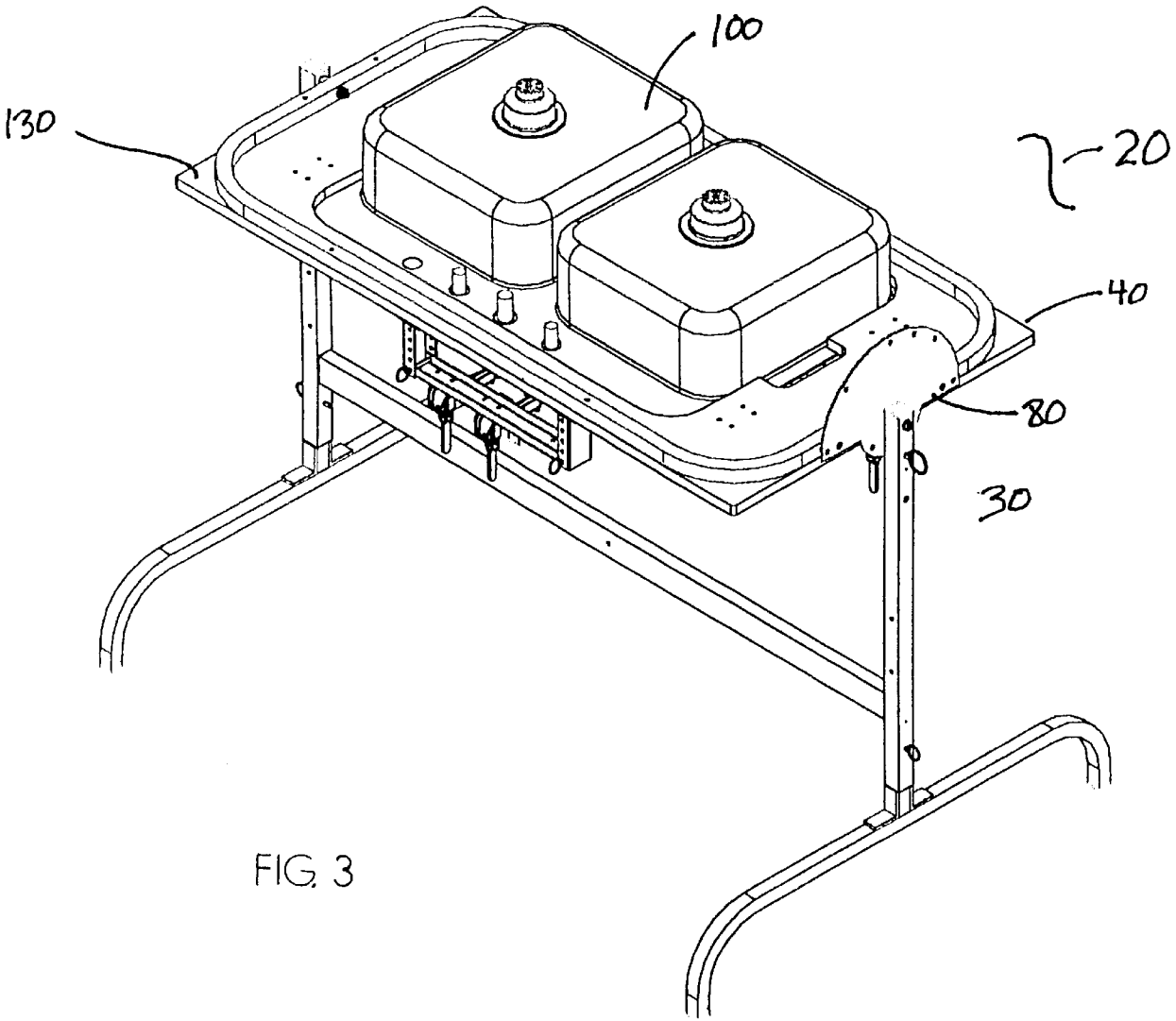
FIG. 3 is a perspective view of the plumbing workstation of FIG. 1 wherein the template is rotated 180 degrees about the horizontal axis.

The template 40 shown in FIG. 1, FIG. 2, FIG. 3, and FIG. 8 is constructed to support a single rectangular sink or a single unit formed into a multiple sink configuration (100). A sink 100 is passed through opening 110 from the top side 120 of the support template 40. The sink flange rests on the top side 120 of the support template 40. Referring to FIG. 1 and FIG. 3, as the sink flange rests on the top side 120, openings for plumbing fixtures, such as faucets, located in the flange of the sink are accessible from both the top side 120 and bottom side 130 of the template 40. As can be readily seen in FIG. 8, FIG. 10, and FIG. 11 a bridge or bridges 42 in combination with multiple toggle clamps are used to temporarily retain plumbing fixtures in place on a sink or sinks prior to installation of the fixtures onto the sink or sinks.

Figure 10:
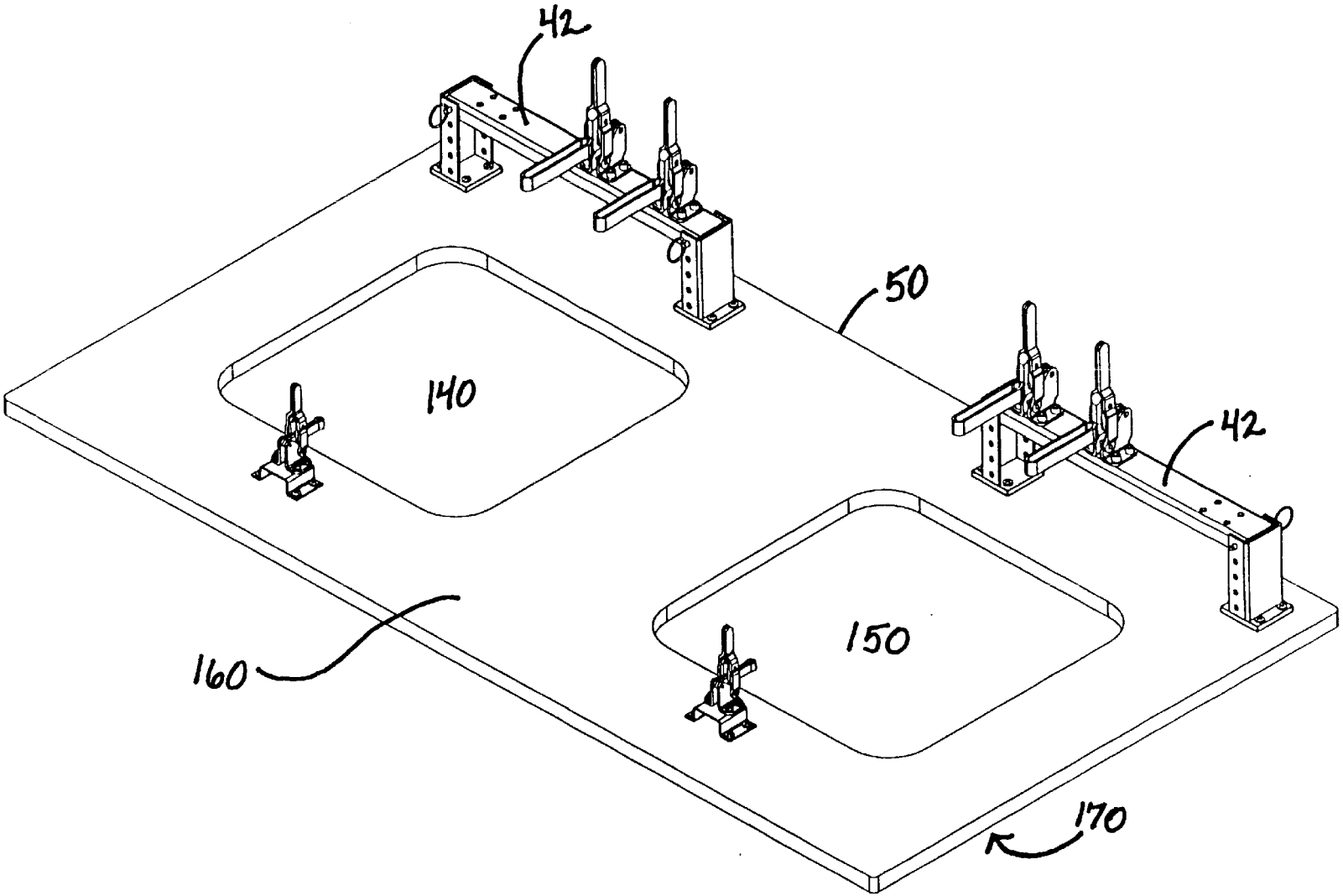
FIG. 10 is a perspective view of a second template for supporting two rectangular sinks.
Figure 11:
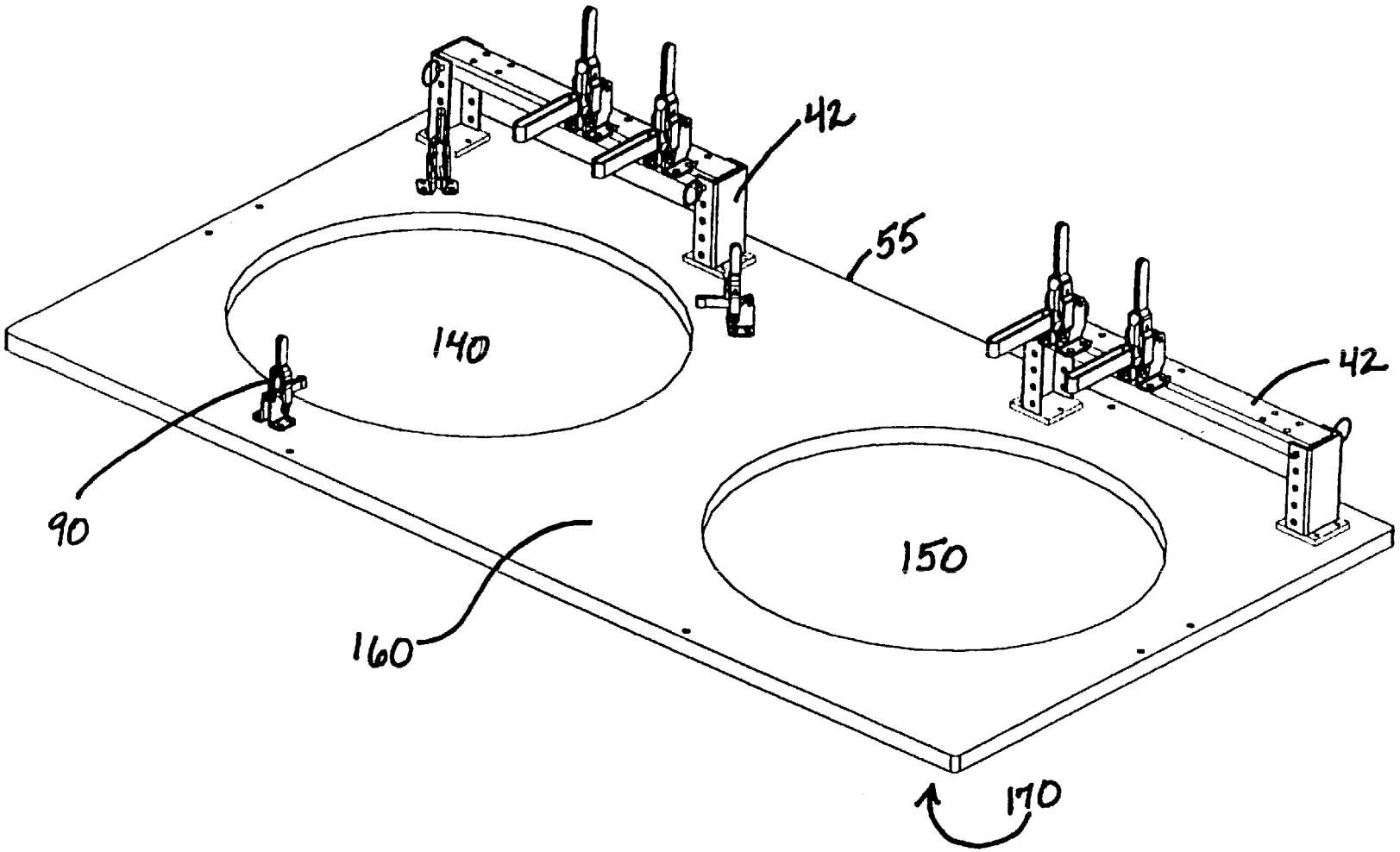
FIG. 11 is a perspective view of an alternate second template constructed to support two round or oval sinks.

A second template 50 shown in FIG. 10 is configured to support two rectangular. FIG. 11 shows an alternate embodiment 55 of the second template arranged and configured to support two round or oval sinks. The second template 50 is interchangeable with the template 40 for mounting on frame 30. The second template is pivotally carried on the frame for 360° rotation about the horizontal axis 70. A first sink with a flange is passed through opening 140 from top side 160 of template 50. A second sink is passed through opening 150 from top side 160. The flanges of the two sinks rest on top side 160 of template 50. As the two sink flanges rest on top side 160, openings for plumbing fixtures such as faucets located in the flanges of the sinks are accessible from both top side 160 and bottom side 170 of template 50.

Figure 12:
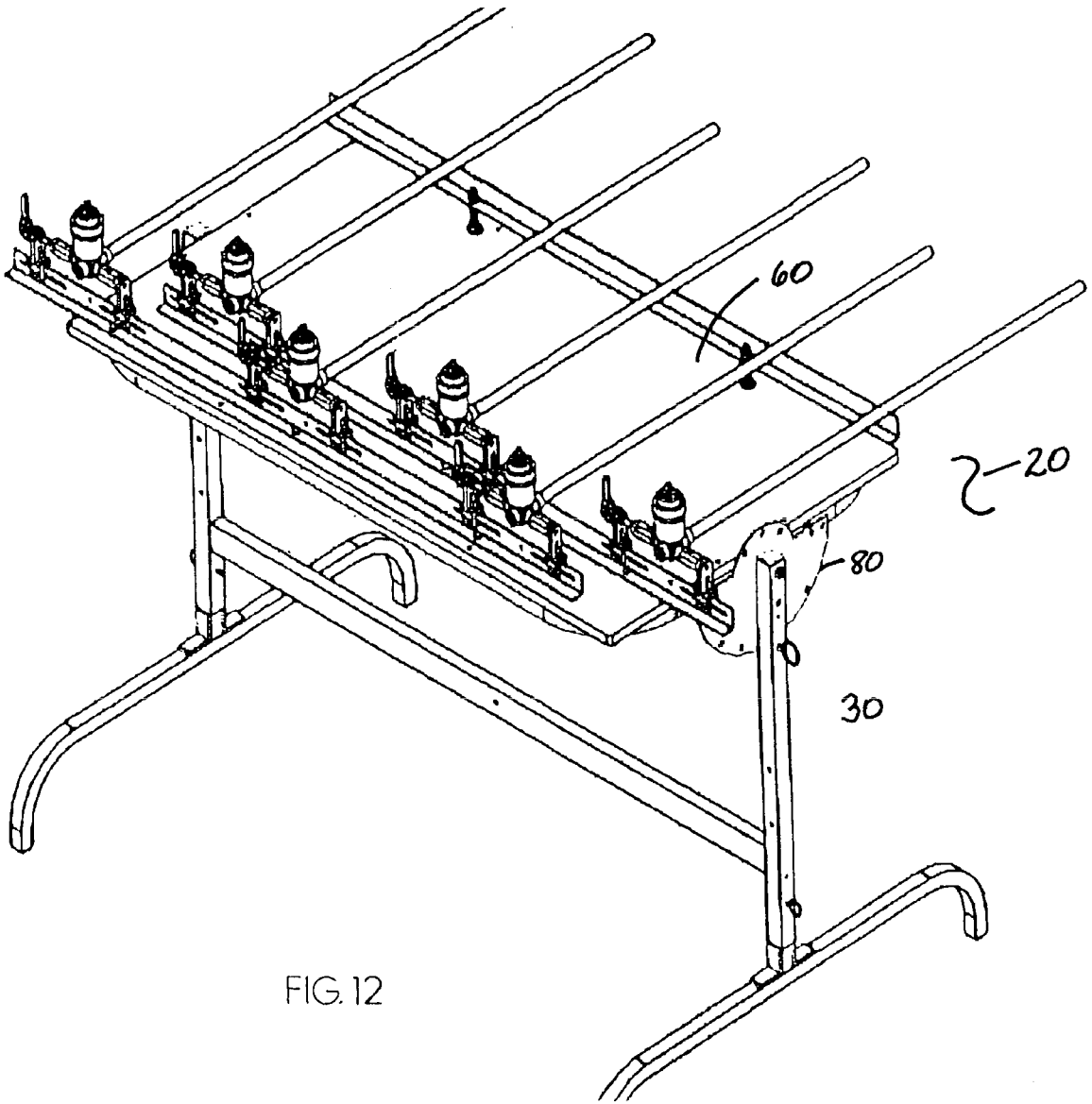
FIG. 12 is a perspective view of the plumbing workstation with a third template for use in assembling tub/shower valve assemblies.
Figure 13:
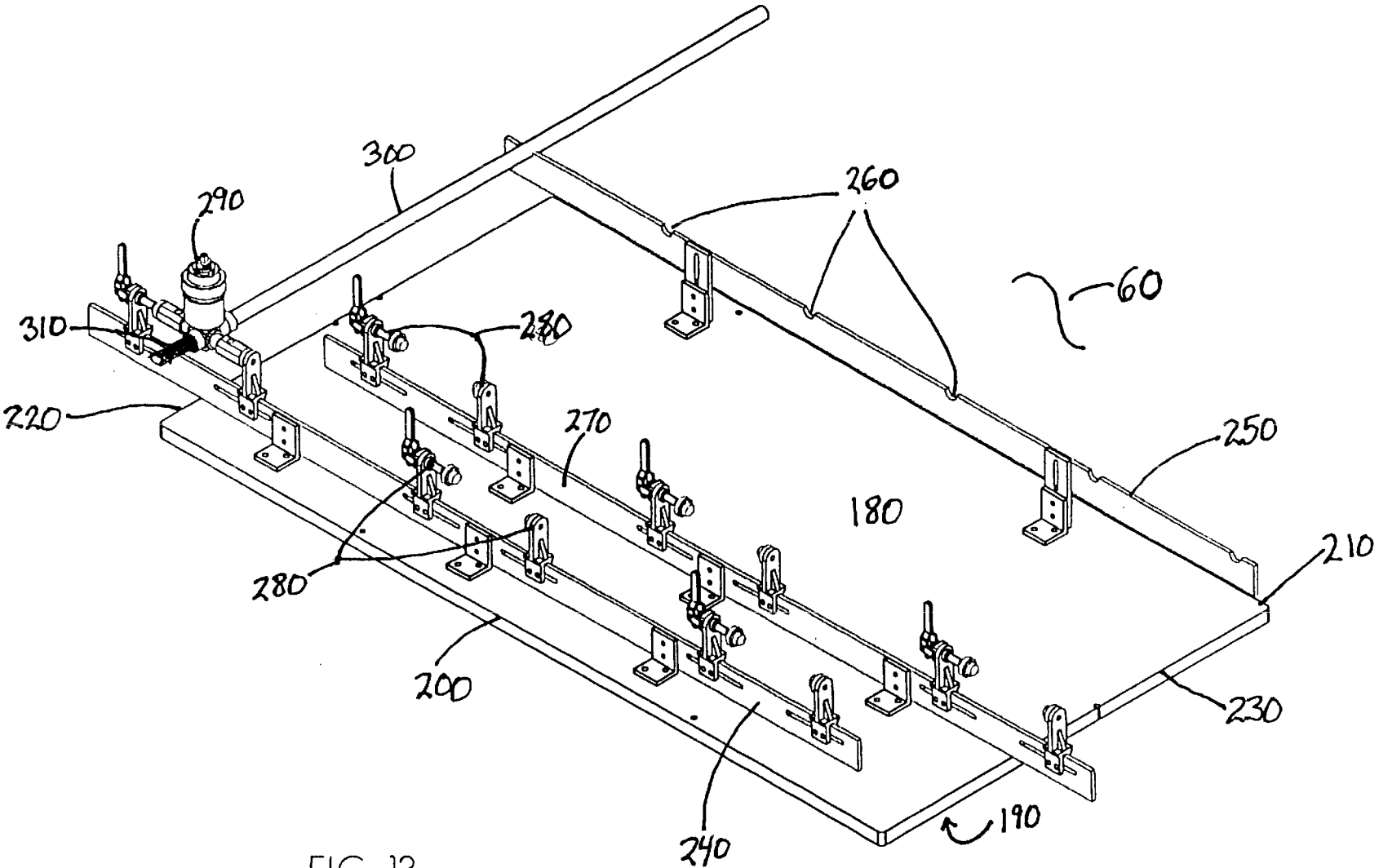
FIG. 13 is a perspective view of the third template for use in assembling tub/shower valve assemblies.

As depicted in FIG. 12 and FIG. 13, the plumbing workstation further comprises a third template 60 configured to allow efficient assembly of tub/shower valve assemblies. The third template 60 is interchangeable with template 40 for mounting on frame 30. The third template is pivotally carried on frame 30 for 360° rotation about the horizontal axis 70. Referring more specifically to FIG. 13, the third template 60 includes a top side 180, a bottom side 190, a first edge 200, a second edge 210 opposite and parallel to the first edge, a third edge 220, a fourth edge 230 opposite and parallel to the third edge, the third and fourth edges perpendicular to the first and second edges, a first bar 240 mounted on the top side 180, the first bar 240 in close proximity and parallel to the first edge 200, a second bar 250 adjustably mounted on the top side, the second bar in close proximity and parallel to the second edge 210, the second bar having one or more grooves 260, a third bar 270 mounted on the top side 180, the third bar parallel to an intermediate of the first bar 240 and second bar 250. The third template 60 further comprises one or more means for retaining 280 one or more tub/shower valves 290. The one or more tub/shower valve retaining means 280 are adjustably mounted on the first bar 240 and the third bar 270 such that when the one or more tub/shower valves 290 are mounted in the one or more tub/shower valve retaining means 280 and one or more shower head pipes 300 are inserted into the one or more tub/shower valves, the opposite end of the shower head pipes rests in groove 260. The second bar 250 may be adjusted upwardly or downwardly so that the shower head pipes inserted into the one or more tub/shower valves is perpendicular to said valves. The tub/shower valve retaining means 280 comprises more than one pair of arm brackets slidably mounted onto first bar 240 and third bar 270. Each pair of arm brackets hold a toggle clamp and a button. Because the arm brackets are slidably mounted onto first bar 240 and second bar 270, the position of the toggle clamps and buttons may be preadjusted to hold and secure different sizes of tub/shower valves manufactured by any particular manufacturers of said valves. The embodiment of the third template as depicted in FIG. 12 and FIG. 13 allows for assembling of up to six tub/shower valve assemblies at a time.

Figure 16:
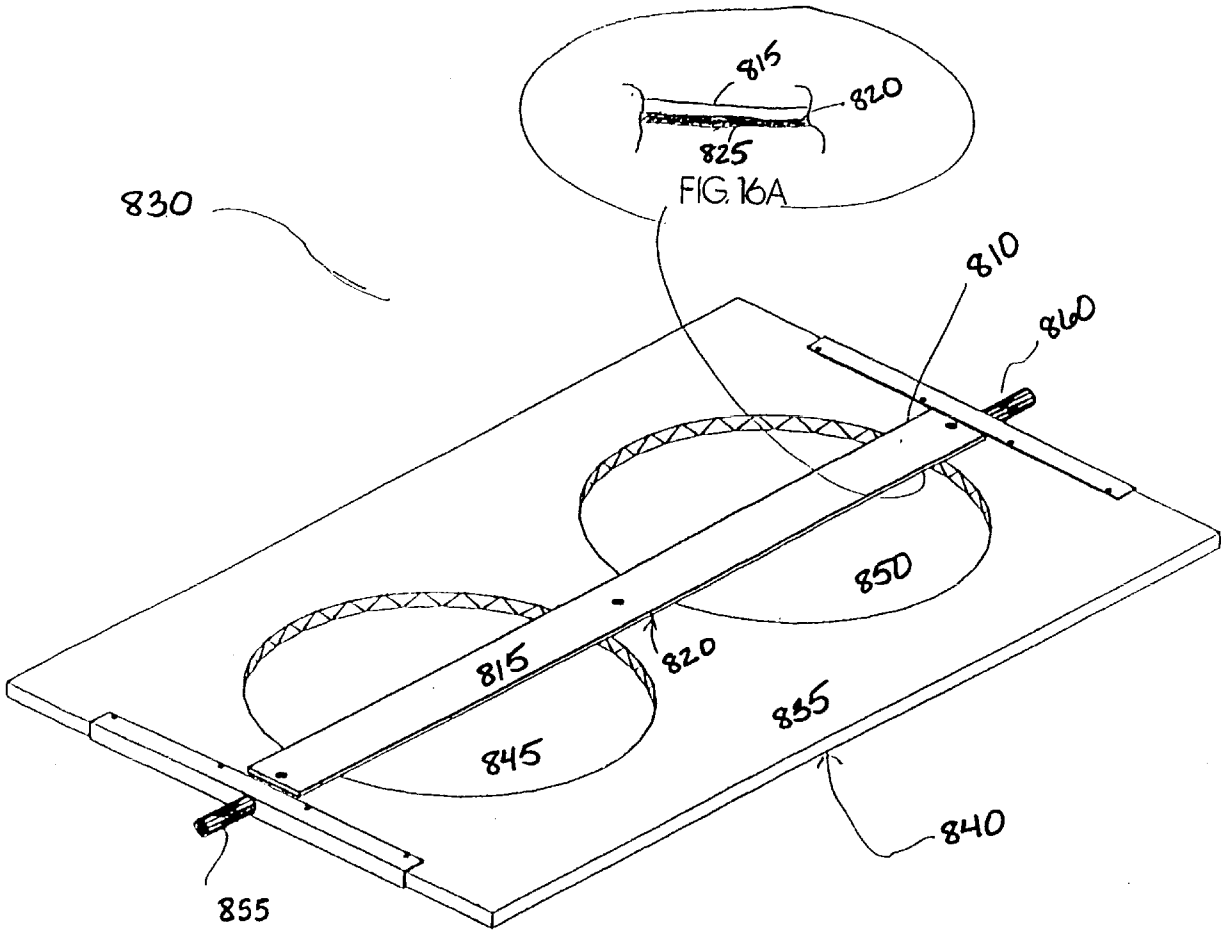
FIG. 16 is an alternate embodiment of a template with two openings that incorporates an alternate embodiment of the sink retainer.

The sink retainer 90 comprises a toggle clamp or equivalent thereof as is well-known in the art. One or more toggle clamps may be used to retain single or multiple sinks as appropriate. An alternate embodiment of the sink retainer is depicted in FIG. 16 and FIG. 16A. This alternate embodiment of the sink retainer 810 comprises a bar with a top side 815 and a bottom side 820. The bar is removably attached to either the template or the second template such that the bottom side of the bar is in contact with the sink and the template thereby trapping the sink into the template. The sink retainer 810 further comprises a protective cushion 825 on the bottom side of the bar wherein the protective cushion is at least one material chosen from rubber, Teflon, plastic, fiber, foam rubber and any combination thereof.

The plumbing workstation further includes at least one means for retaining sink drain attachments. The sink drain attachment retaining means holds sink drain attachments such as garbage disposals, basket drainers, and pop-up drain assembles firmly in place while the sink and template are rotated from a horizontal angular position to a second angular position about the horizontal axis and the worker applies pressure to install the attachments on the sink. The sink drain attachment retainer may be used in conjunction with any template.

Figure 8:
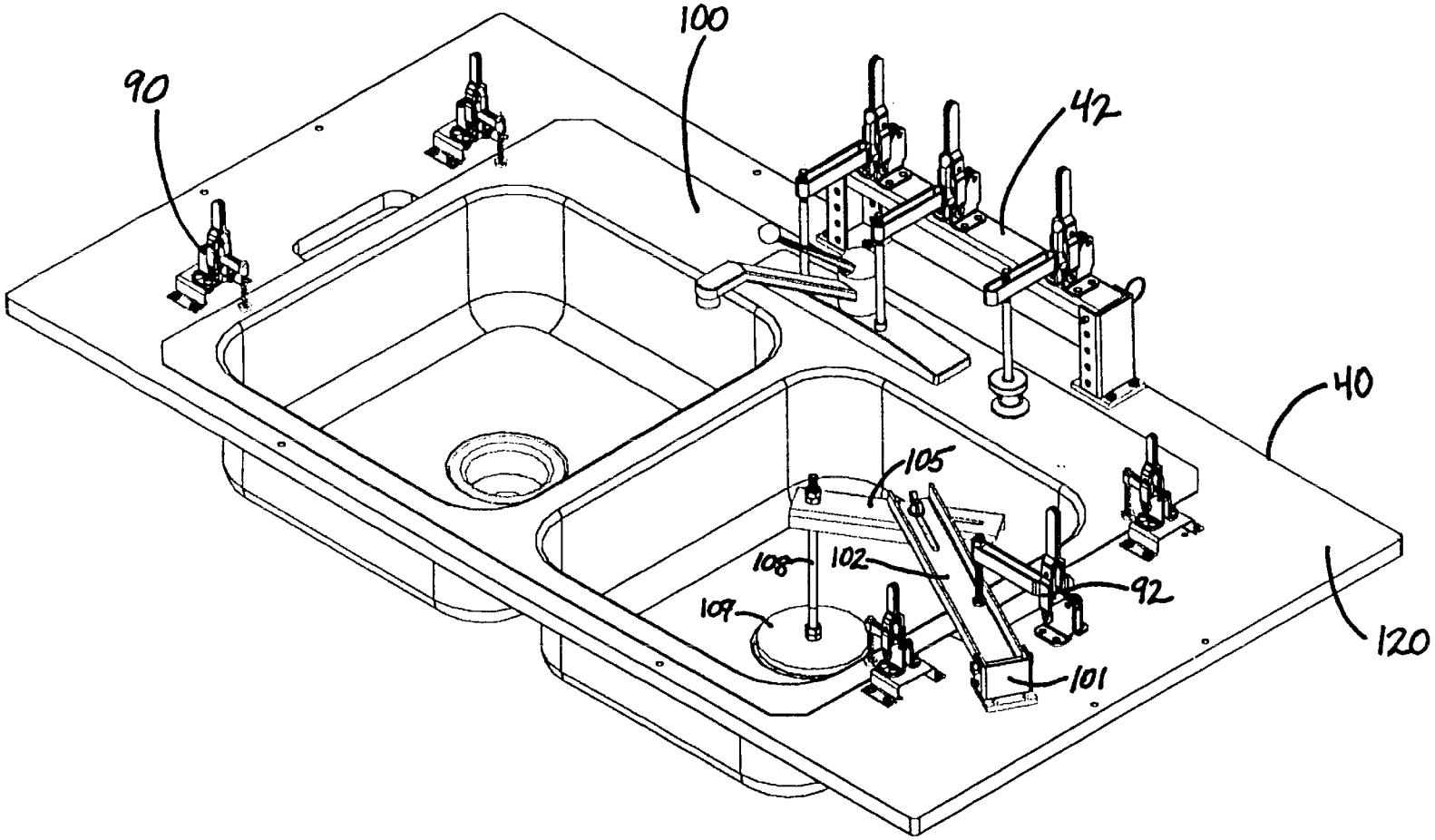
FIG. 8 is a perspective view of the template of FIG. 7 with a unibody double sink installed on the template.
Figure 9:
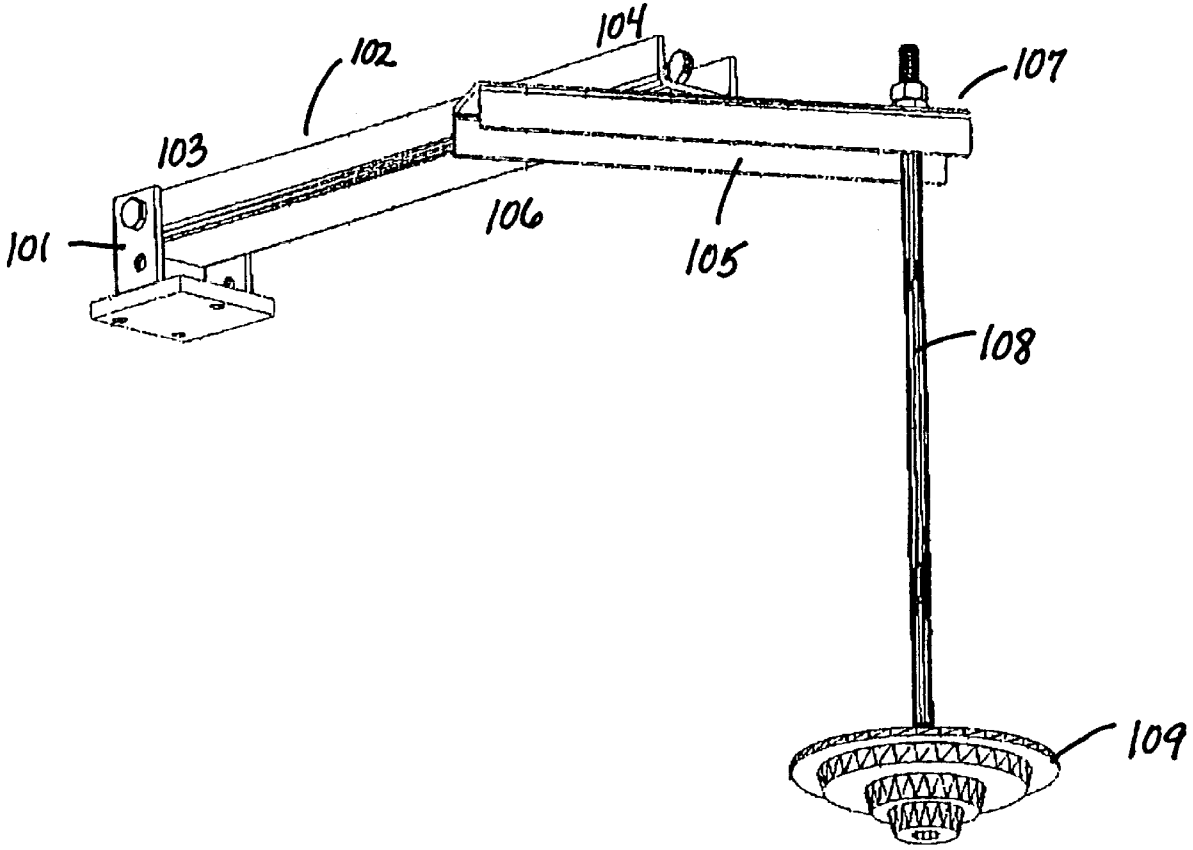
FIG. 9 is a perspective view of the sink drain attachment retainer.

As illustrated in FIG. 1, FIG. 8 with sink 100 installed on template 40, and FIG. 9, the sink drain attachment retainer comprises a bracket 101 mounted on topside 120 of template 40, a first horizontal member 102 having a first end 103 and a second end 104. The first horizontal member 102 is pivotally attached to bracket 101 in close proximity to first end 103 and extends horizontally from topside 120 over sink 100. The sink drain attachment retainer further comprises a second horizontal member 105 having a first end 106 and a second end 107. The second horizontal member 105 is slidably attached to the first horizontal member 102 in close proximity to first horizontal member's second end 104 and second horizontal member's first end 106. The second horizontal member 105 extends horizontally over sink 100 from first horizontal member 102. The sink drain attachment retainer further comprises a vertical member 108 with a proximal end and a distal end. The vertical member's proximal end is attached to the second horizontal member in close proximity to second end 107 and extends downwardly therefrom. Attached to the distal end of the vertical member 108 is stopper element 109 comprising multiple concentric elements of various diameters all extending perpendicularly from vertical member 108 as depicted in FIG. 9.

In operation, the first horizontal member 102 and second horizontal member 105 are manipulated to position stopper 109 over a sink drain. Stopper 109 then is lowered until it contacts the sink drain attachment being installed. Referring specifically to FIG. 8, toggle clamp 92 is actuated against the top of first horizontal element 102, thereby locking the sink drain attachment retainer in position and securing the drain attachment such that when the template and sink are rotated about the horizontal axis and secured in a second angular position, a worker can install the sink drain attachment.

Figure 4:
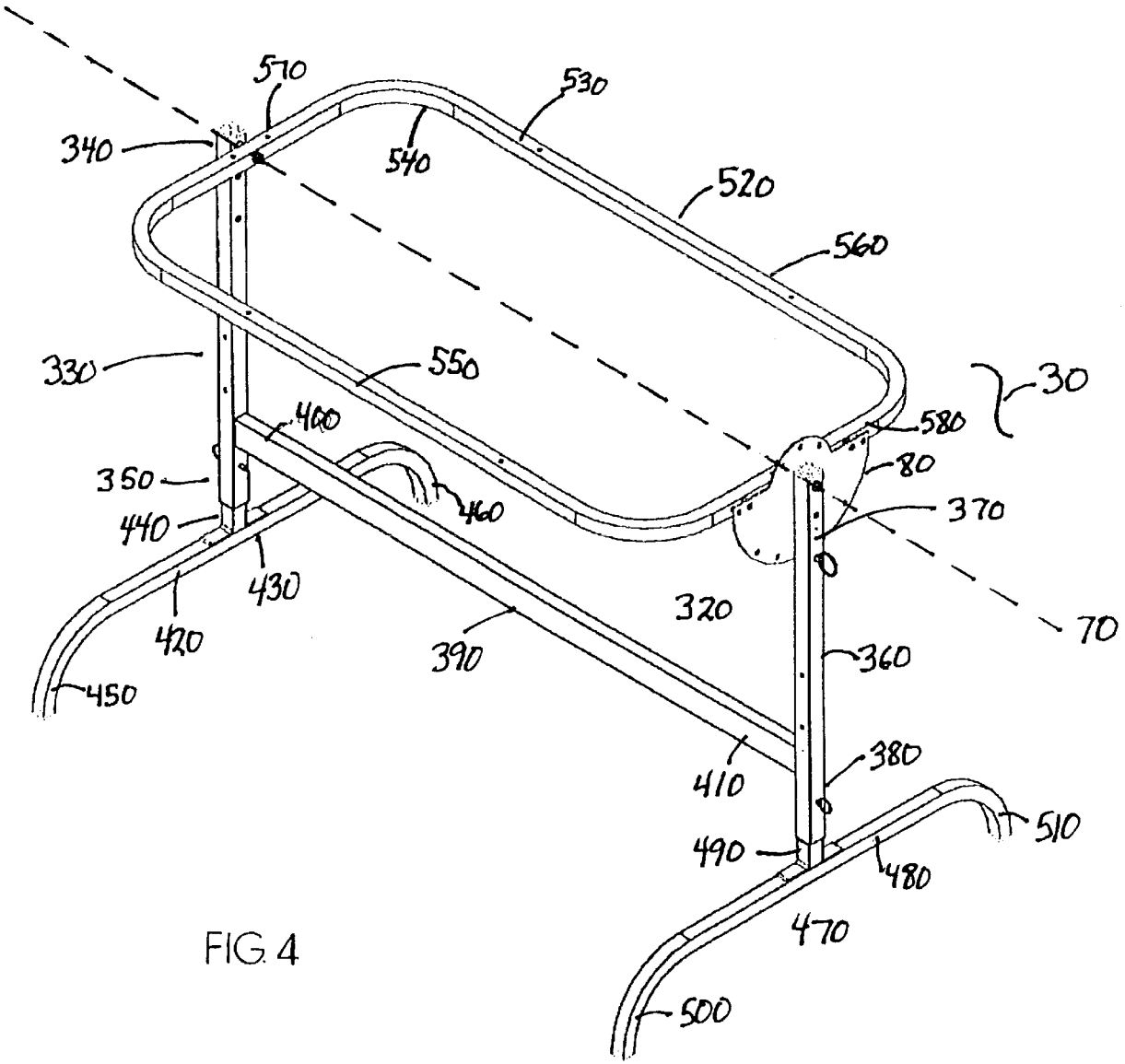
FIG. 4 is a perspective view of the frame.

Referring to FIG. 4, the frame of the preferred embodiment comprises an H member 320 having a first vertical tube 330 and a second vertical tube 360 and a horizontal tube 390. The first vertical tube has a proximal end 340 and a distal end 350. The proximal end 340 has at least two holes there through, the at least two holes having center lines perpendicular to the first vertical tube and parallel to the horizontal axis 70. The distal end 350 of the first vertical tube 330 has at least one hole there through. The second vertical tube 360 has a proximal end 370 and a distal end 380. The proximal end 370 of the second vertical tube 360 has at least two holes there through which have center lines perpendicular to the second vertical tube 360 and parallel to the horizontal axis 70. The distal end 380 has at least one hole there through. The horizontal tube 390 has first end 400 and a second end 410. The first end 400 is fixedly attached to the first vertical tube 330 intermediate of the first vertical tube's proximal and distal ends. The second end 410 of the horizontal tube 390 is fixedly to the second vertical tube 360 intermediate of the second vertical tube's proximal and distal ends. The frame further comprises a first foot member 420 having a horizontal member 430 and a vertical member 440. The horizontal member 430 has a first end 450 and a second end 460. The vertical member 440 is fixedly attached to the horizontal member 430 intermediate of the horizontal member's first and second ends. The vertical member 440 extends upwardly and perpendicularly from the horizontal member 430. The vertical member 440 has at least one hole there through and is constructed to slide into the distal end 350 of the H member's first vertical tube 330. When the first vertical member's at least one hole and the first vertical tube distal end's at least one hole are aligned, a pin may be inserted there through, thereby locking together the first vertical tube 330 and the vertical member 440 such that the first foot member's horizontal member 430 is perpendicular to the horizontal axis 70. The frame further comprises a second foot member 470 having a horizontal member 480 and a vertical member 490. The horizontal member 480 having a first end 500 and a second end 510. The vertical member 490 is fixedly attached to the horizontal member 480 intermediate of the horizontal member's first 500 and second 510 ends. The vertical member extends upwardly and perpendicularly from the horizontal member and the vertical member 490 has at least one hole there through. The vertical member 490 is constructed to slide into the distal end 380 of the H member's second vertical tube 360. When the first vertical member's at least one hole and the second vertical tube's distal end at least one hole are aligned, a pin may be inserted there through thereby locking together the second vertical tube 360 and the vertical member 490 such that the horizontal member 480 is perpendicular the horizontal axis 70.

The frame 30 further comprises a template support 520 having a topside 530, a bottom side 540, a first edge 550, a second edge 560, a third edge 570, and a fourth edge 580. The first edge 550 is opposite and parallel to the second edge 560. The third edge 570 is opposite and parallel to the fourth edge 580. The third and fourth edges are perpendicular to the first and second edges. The third edge 570 is pivotally attached at its midpoint to the first vertical tubes proximal end 340. The fourth edge 580 is pivotally attached at its midpoint to the second vertical tubes proximal end 370.

Figure 5:
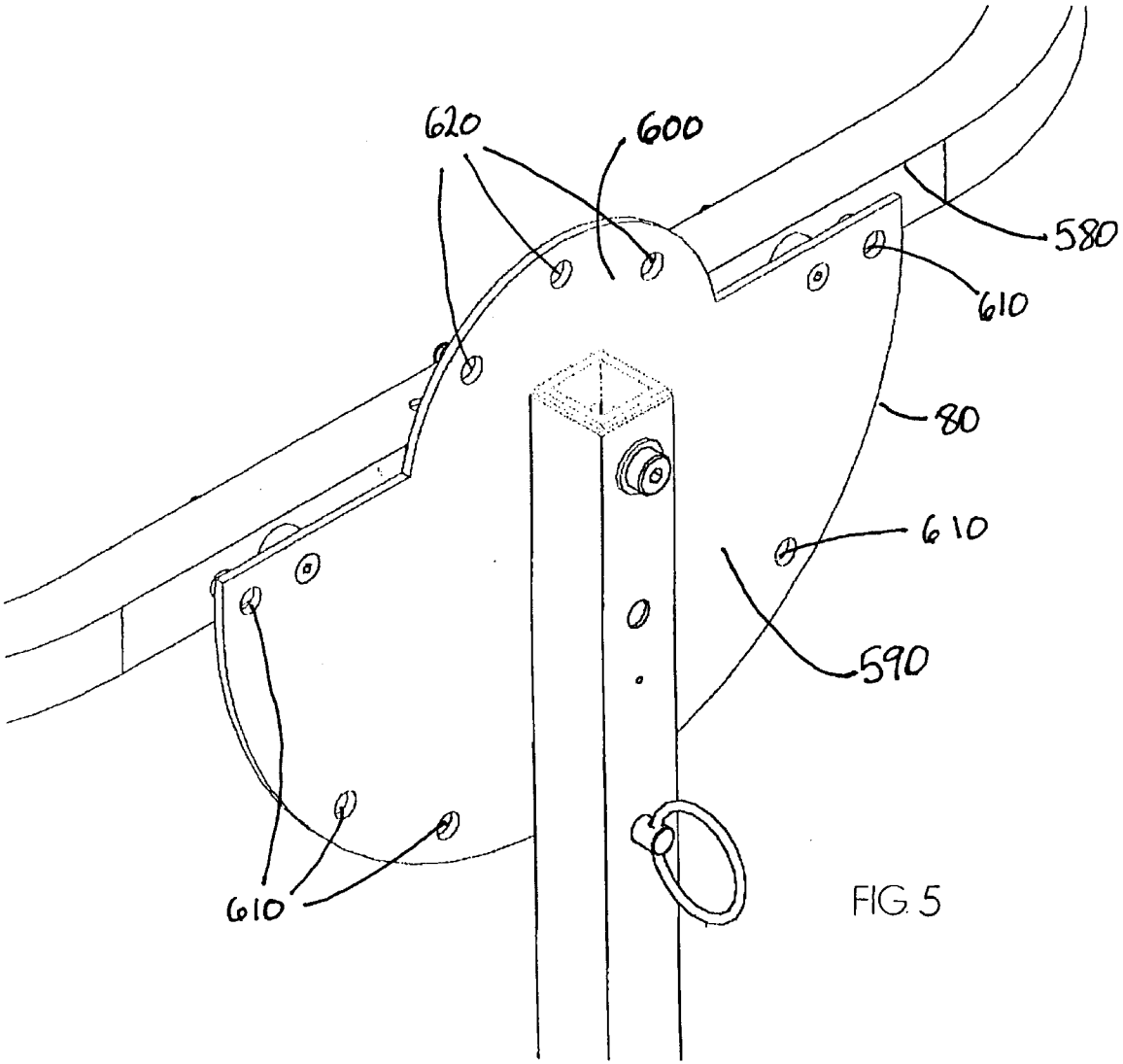
FIG. 5 is an exploded perspective view of the arc plate.

The frame 30 further comprises an arc plate 80 as shown in FIG. 1 through FIG. 5. Referring specifically to FIG. 5, the arc plate 80 is fixedly attached and horizontally centered on the template supports fourth edge 580 although, the arc plate may also be mounted on the template supports third edge as depicted in FIG. 1. Referring again to FIG. 5, the arc plate 80 comprises a shaped plate with a larger half circle 590 extending downwardly from the fourth edge 580. The arc plate 80 further comprises a smaller half circle 600 extending upwardly from the fourth edge 580. The larger half circle 590 includes a plurality of holes 610 arranged along its circumference. The smaller half circle 600 includes a plurality of holes 620 arranged along its circumference. When any of the holes on the larger or smaller half circles are aligned with the second vertical tubes proximal end holes, a pin may be inserted there through, thereby locking the template support in a specific angular position about the horizontal axis 70.

Figure 6:
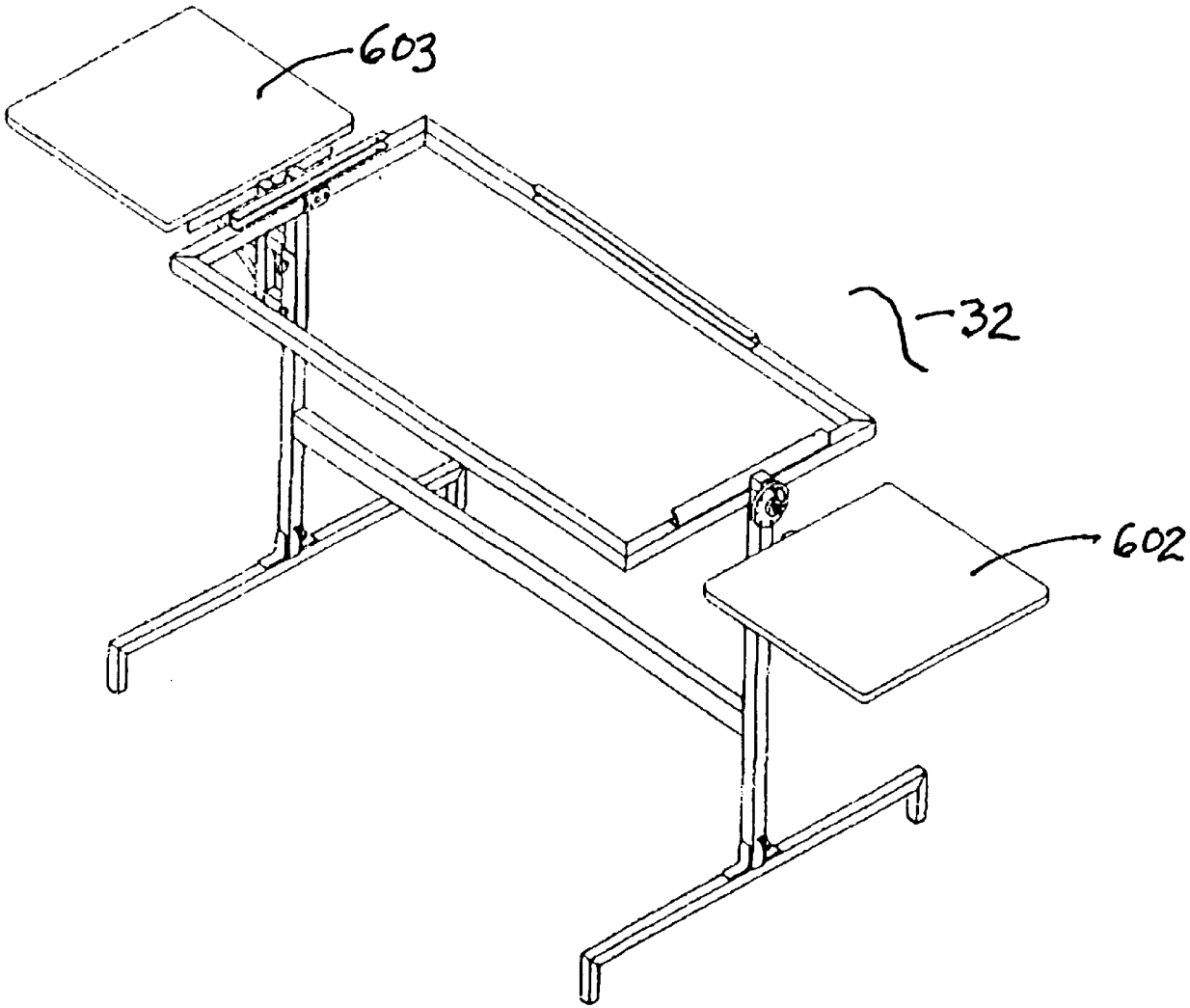
FIG. 6 is a perspective view of an alternate embodiment of the frame incorporating side tables.

Referring to FIG. 6, an alternate embodiment of the frame 32 is depicted. Frame 32 includes one or more side tables 602, 603 releaseably attached to the frame 32. The side tables can be used by a worker to hold tools and other implements necessary to assemble sinks and/or tubs/showers valve assembles. The side tables 602, 603 may be incorporated in any embodiment of the frame.

Methods of Use

Figure 7:
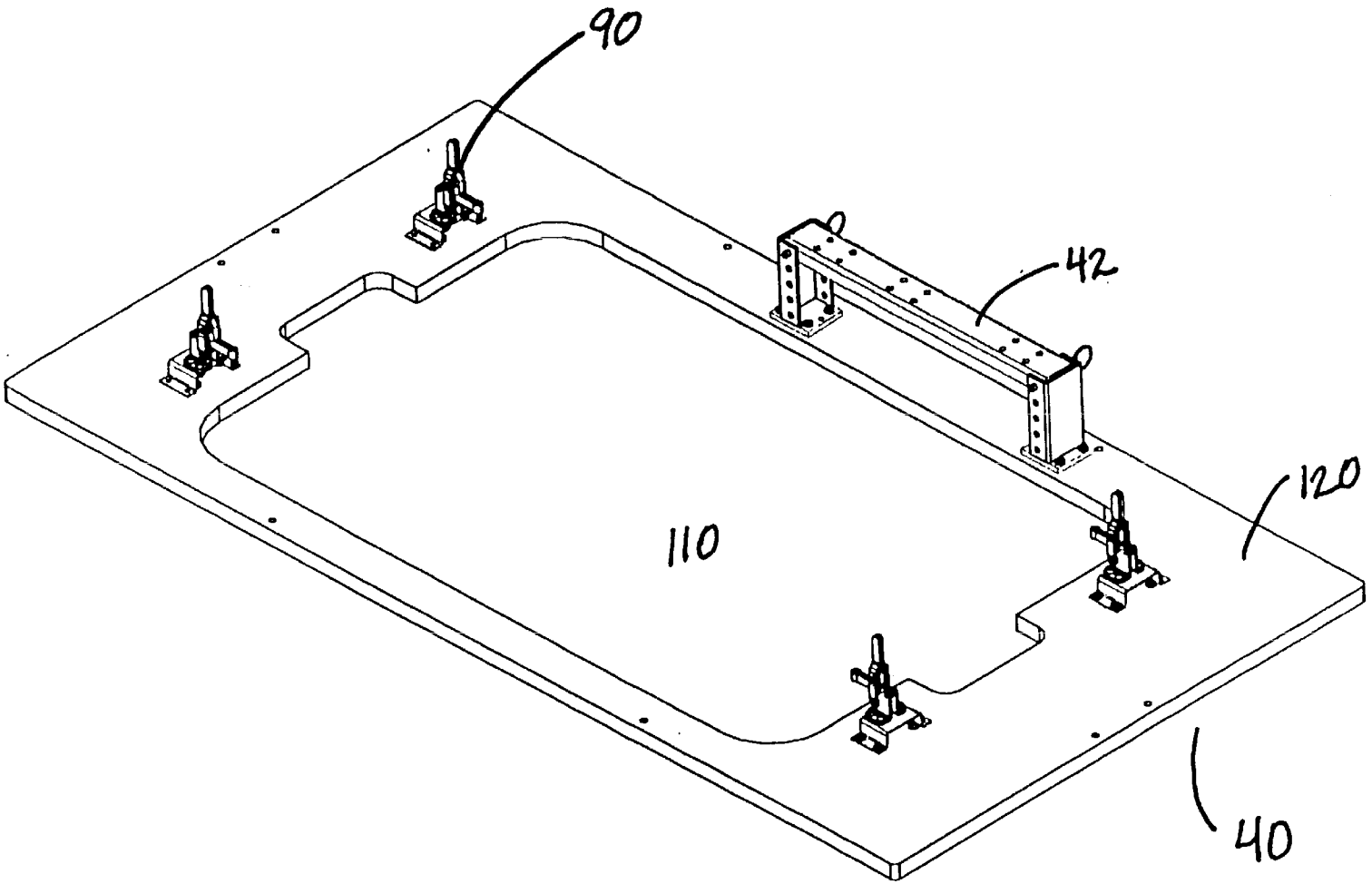
FIG. 7 is a perspective view of a template.

The plumbing workstation can be used at any job site where a sink or sinks or tub/shower valves will be installed. The most effective use of the plumbing workstation, however, occurs on jobs involving multiple units where many of the same type of sink or tub/shower valve assemblies will be installed, e.g., apartment buildings and hotels. Typically, the plumbing workstation is transported to a job site and set up. A template is chosen based upon the sink or sinks to be worked on. For instance, if a kitchen sink is the type to be installed, a template 40 similar to that depicted in FIG. 7 may be appropriate.

Once the appropriate template has been chosen, it is installed on the frame and typically locked into a roughly horizontal position via the releasable lock. The sink is inserted into the template 40 opening 110 from the top side 120 to the bottom side. The sink flange rests on the top side of the template and any openings in the flange suitable for receiving plumbing fixtures are accessible from both the top side and bottom side of the template. Next, the sink is secured into the template using at least one sink retainer 90. Alternately, any common device known in the art may be used to secure the sink.

Once the sink is secured in the template, the worker can place the fixtures on the sink, temporarily secure them, and then rotate the template to an appropriate angular position where final installation of the fixtures will be preformed. Alternatively, the worker can either install plumbing fixtures from the roughly horizontal position or unlock the template, rotate it with its retained sink to a more desirable angular position about the horizontal axis 70 and lock the template at that more desirable angular position. The worker can then select a plumbing fixture and install it on the sink while standing upright in a comfortable position. The remaining plumbing fixtures can then be installed. In the case of kitchen sinks, plumbing fixtures could include faucets, garbage disposals, spray assemblies, basket strainers, and soap dispensers.

Once all the plumbing fixtures are installed on the sink, the template is unlocked and rotated back to the roughly horizontal position. The sink is unsecured and removed from the template. The assembled sink is now ready to be placed into the counter top for quick connection of water supply lines and waste lines. The entire process is repeated until all the sinks requiring the chosen template are assembled.

If another size, type or number of sinks are also to be installed at the same job site, as is typically the case in apartment buildings where apartments will have a kitchen requiring one type of sink and at least one bathroom which requires a different type of sink or sinks, then the template used for the single sink as previously discussed is removed from the frame. In the case of twin round bathroom sinks, the appropriate template 55, as shown in FIG. 11, is chosen. The second template 50 is installed on the frame and locked into a roughly angular position. If the frame includes a height adjustment feature, the height can be set either before or after the template is installed on the frame.

Next, the two round sinks are installed on the template 55 through openings 140 and 150 from the top side 160 to the bottom side 170. The flanges of the sinks rest on the top side such that flange openings are accessible from both the top side and bottom side. The two round sinks are then secured in place using more than one sink retainer 90. The worker can temporarily service plumbing fixtures using the template's bridges and toggle clamps, rotate the template into a comfortable working angular position and lock it into place. The appropriate plumbing fixtures can be installed on the two sinks. In the case of twin bathroom sinks, the appropriate plumbing fixtures would generally comprise a faucet, drain assembly and pop up assembly for each sink.

In another embodiment, the plumbing workstation may also be used to assemble tub/shower valve assemblies. A template is chosen suitable for assembling one or more tub/shower valve assemblies such as template 60 as depicted in FIG. 13. Template 60 is installed onto the frame and locked into a roughly horizontal position on the frame. One or more tub/shower valves are mounted onto the template. Shower head pipes 300 are inserted into the tub/shower valves 290 and the second bar 250 is vertically adjusted such that the shower head pipe 300 is perpendicularly aligned with the tub/shower valve. Next, tub head pipes 310 are inserted into the tub/shower valves 290. The shower head pipes 300 and tub head pipes 310 are then soldered into the tub/shower valve assemblies in accordance with common practices in the art. Once assembly is complete, the tub/shower valve assemblies are removed from the template and may then be installed into their final locations in bathrooms as appropriate and common in the art.

Alternate Embodiments

Figures 14, 14A:
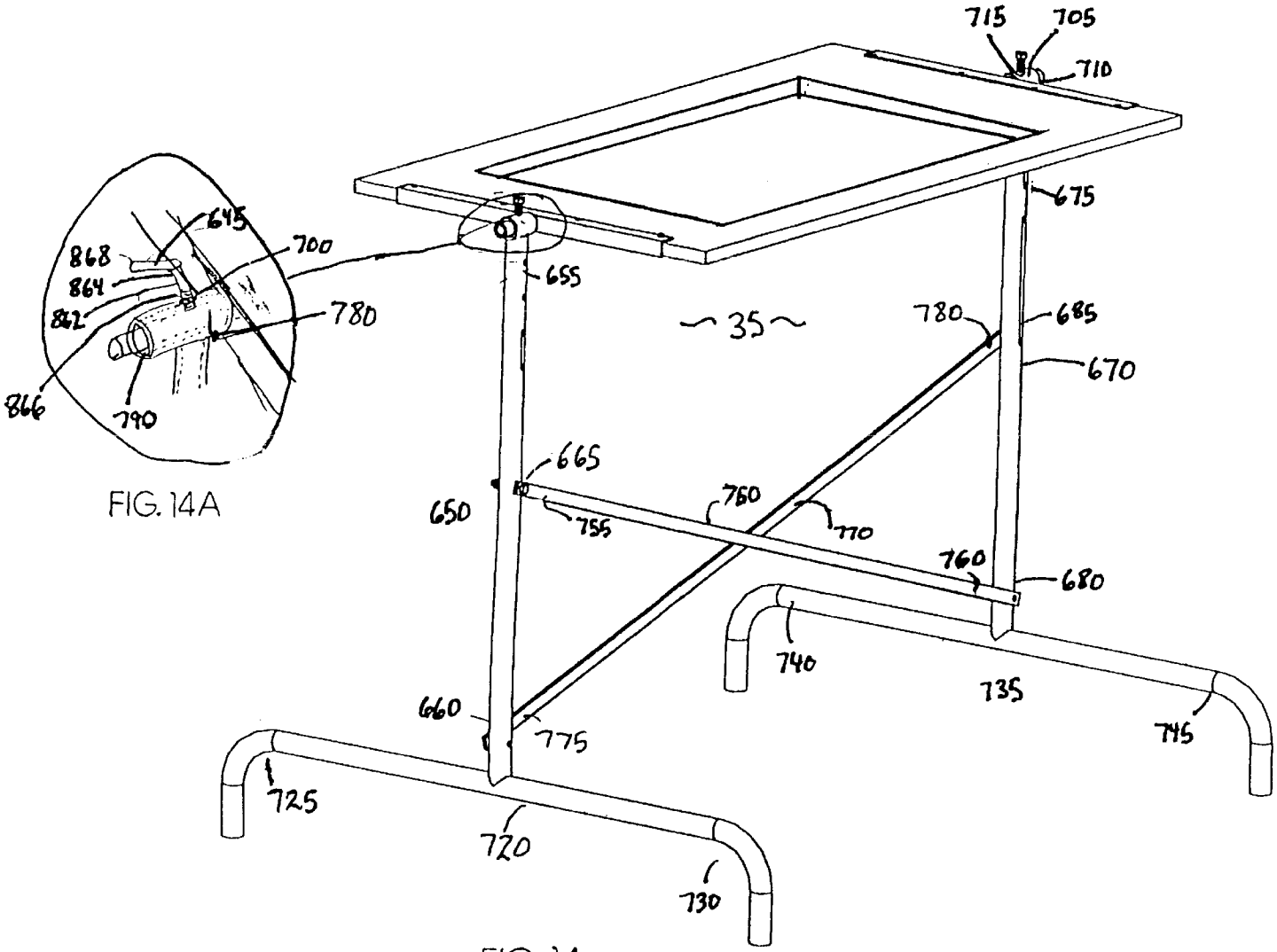
FIG. 14 is a perspective view of an alternate embodiment of the plumbing workstation with a single opening support template installed on the frame.
FIG. 14A is an exploded view of the alternate embodiment frame cylindrical collar and releaseable lock.
Figure 15:
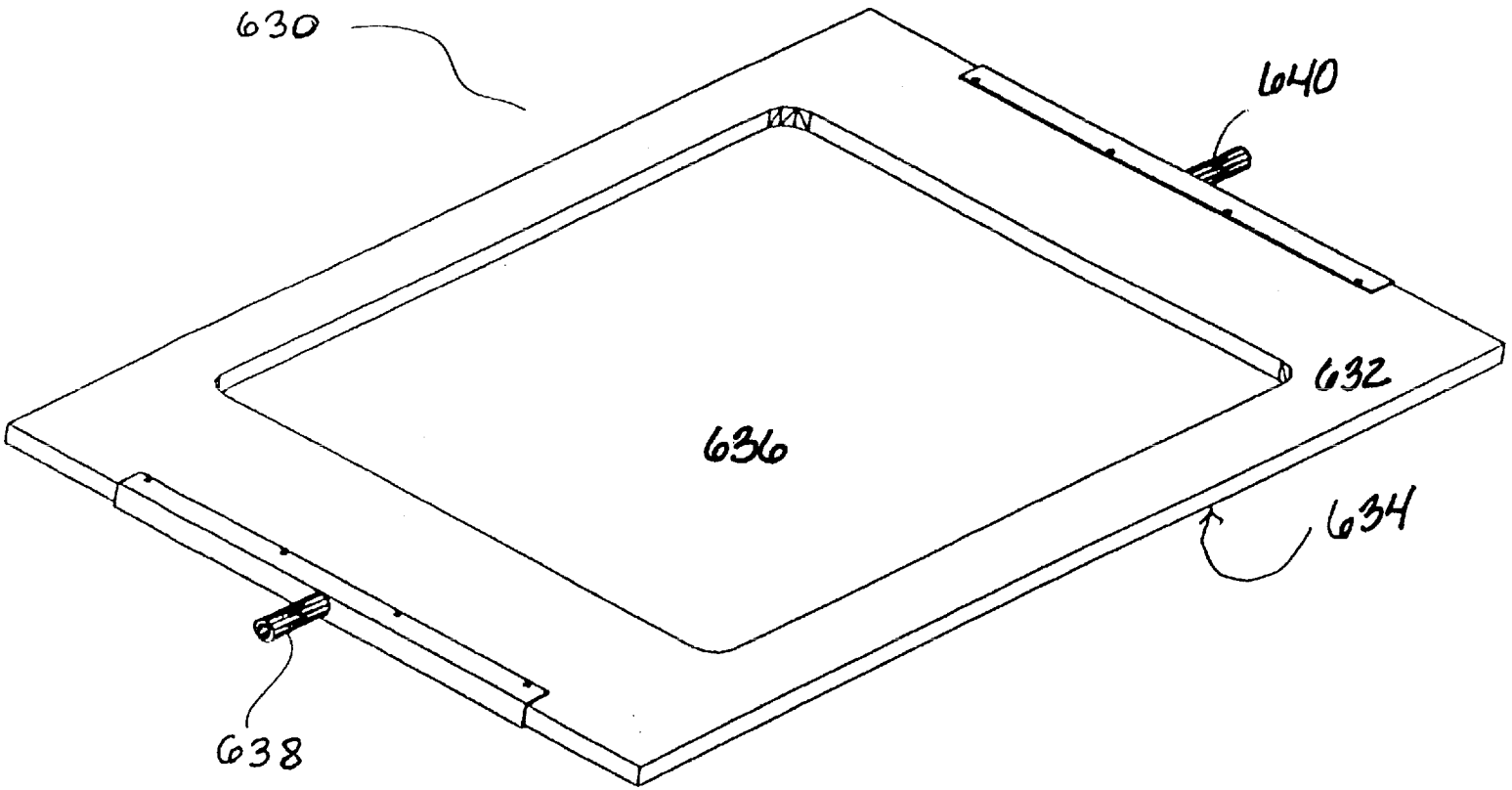
FIG. 15 is an alternate embodiment of a support template with a single opening.

FIGS. 14 through 23 show alternate embodiments at the present invention. Referring to FIG. 15 and FIG. 16, two alternate templates 630, 830 are shown. Template 630 includes a first stub shaft 638 and a second stub shaft 640. Alternate template 830, shown in FIG. 16, also includes a first stub shaft 855 and a second stub shaft 860. The stub shafts are carried on alternate frames 35, 900 as is discussed below.

The frame can be any configuration commonly known in the art suitable for receiving and supporting a template. By way of additional example, FIG. 14 depicts a frame 35 having a first vertical member 650, a second vertical member 670, a first horizontal member 720, a second horizontal member 735, a first cross-bar 750, and a second cross-bar 770. The first vertical member 650 has a top end 655 and a bottom end 660. The bottom end 660 is fixedly attached to the first horizontal member 720 intermediate of the first horizontal members first end 725 and second end 730. The second vertical member 670 has a top end 675 and a bottom end 680. The second vertical member's bottom end 680 is fixedly attached to the second horizontal member 735 intermediate of the second horizontal member's first end 740 and second end 745.

Figure 17:
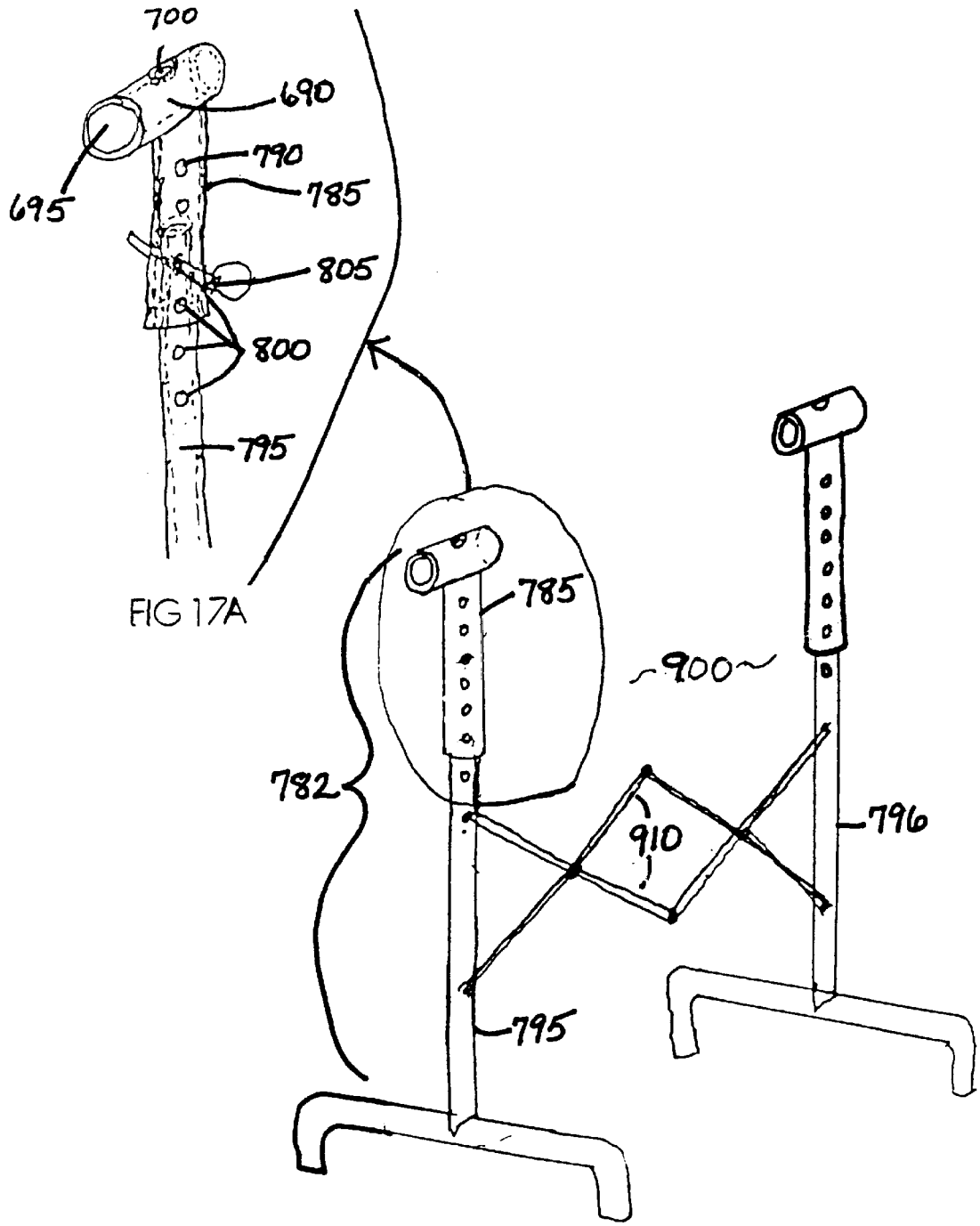
FIG. 17 is perspective view of an alternate embodiment of the frame which includes a height adjustment feature and a scissor cross support.

Additional cross-torsional stability for the frame 35 is provided by the first cross-bar 750 and second cross-bar 770. The first cross-bar 750 has a first end 755 and a second end 760. The second cross-bar 770 also has a first end 775 and a second end 780. The second cross-bar's first end 775 is attached to the first vertical member 650 in close proximity to the first vertical member/first horizontal member junction. The first cross-bar's second end 760 is attached to the second vertical member 670 in close proximity to the second vertical member/second horizontal member attachment point. The first cross-bar's first end 755 is releaseably attached to the first vertical member 650 at a point 665 above the first vertical member/second cross-bar attachment point. And, the second cross-bar's second end 780 is releaseably attached to the second vertical member 670 at a point 685 above the second vertical member/first cross-bar attachment. This vertical member and cross-bar arrangement allows the frame to be collapsed to facilitate storage and transport of the frame when the first cross-bar's first end 755 and the second cross-bar's second 780 are detached from the first vertical member 650 and second vertical member 670 respectively. Referring to FIG. 17, in an alternative embodiment of the frame 900, the collapsible feature can be achieved by replacing the cross-bar configuration of FIG. 14 with a collapsible scissor-support arrangement 910 mounted between the first member 795 and the second member 796.

Referring to FIG. 14 and FIG. 14A, fixedly attached to the top end 655 of the first vertical member 650 is a first cylindrical collar 780. The first cylindrical collar defines a first opening 790 there through with a centerline that is perpendicular to both the first vertical member 650 and the first horizontal member 720. The first cylindrical collar 780 further includes a second threaded opening 700 with a centerline perpendicular to the centerline of the first opening 790. The second opening 700 is suitable for receiving a releasable lock 645. The first cylindrical collar 780 pivotally carries the template 630, 830 first stub shaft 638, 855, respectively.

A second cylindrical collar 705 defining a first opening 710 is fixedly attached to the top end 675 of the second vertical member 670. The centerline of the first opening 710 is perpendicular to both the second vertical member 670 and the second horizontal member 735. The second cylindrical collar also includes a second opening 715 that is threaded and suitable for receiving a releasable lock. The second cylindrical collar 705 pivotally carries template 630, 830 second stub shaft 640, 860, respectively.

The centerline of the first cylindrical collar first opening 790 together with the centerline of the second cylindrical collar first opening 710 form the horizontal axis about which the template 630, 830 rotates. More specifically, the template stub shafts are pivotally carried in the first and second cylindrical collars allowing the template to be rotatable about the horizontal axis. The rotatability feature of the present invention can be accomplished any other manner common in the art. By way of example only and without intent to limit the scope of the present invention, rotation of the template about the horizontal axis could be accomplished via a ball and socket arrangement wherein balls would be mounted on the end of the stub shafts or simply replace the stub shafts and sockets would replace the cylindrical collars. The sockets would pivotally carry the balls thereby allowing the template to be rotatable around the horizontal axis. In a third alternative, the cylindrical collars could be replaced with chuck mechanisms that lock around the stub shafts but still allow the template to rotate about the horizontal axis. The quick release feature common to today's chucks would allow for quick interchangeability of templates.

Referring to FIG. 16 and FIG. 16A, an alternate embodiment of the sink retainer is shown. Sinks are secured into the template by sink retainer 810 having a top side 815 and a bottom side 820. As shown in FIG. 16A, protective cushion 825 is fixed on the bottom side 820. In use, the bottom side 820 with the protective cushion 825 is contacted against the sink and the sink retainer 810 is then secured in any conventional means to the template thereby trapping the sink in the template such that when the template is rotated about the horizontal axis, the sink will be retained in the template. The protective cushion 825 protects the sink from scratches and can be made from any suitable material such as rubber, foam, foam rubber, fiber, plastic, Teflon, air or liquid filled bladder and any combination thereof.

As shown in FIG. 14A, the releasable lock 645 comprises a first shaft 862 with a top end 864. Opposite the top end 864, is a threaded end 866 suitable for screwing into the first cylindrical collar's second threaded opening 700. A first handle 868 is fixedly attached to the top end 864. In operation, the releasable lock 645 is screwed into the second threaded opening 700 and against the first stub shaft 638, 855 thereby securing the template 630, 830 at a selected angular position about the horizontal axis. Unscrewing the releasable lock 645 removes pressure from the sink support template stub shaft 638, 855 and allows the template 630, 830 to be rotated about the horizontal axis. The releasable lock can be used at the first cylindrical collar 780, the second cylindrical collar 705 or both. When the releasable lock is used at the second cylindrical collar 705, a second shaft with a threaded end and a second handle fixedly attached to the top end of the second shaft is screwed into the second cylindrical collars second threaded opening 715 and against the template's 630, 830 second stub shaft 640, 860, thereby locking the template at a selected angular position about the horizontal axis.

FIG. 17 and FIG. 17A shows another alternate embodiment of the frame 900 that allows the vertical position of the horizontal axis to be adjusted by a worker to a comfortable height. In this alternate embodiment of the frame, the first vertical member 782 comprises a hollow tube top end 785 with a plurality of openings 790 there through with centerlines perpendicular to the centerline of the first cylindrical collar's first opening 695. The bottom end 795 of first vertical member 782 is a second hollow tube containing more than one opening 800 with centerlines perpendicular to the centerline of the first cylindrical collar's first opening 695. The internal diameter of the hollow tube top end 785 is greater than the external diameter of the bottom end hollow tube 795, which allows the top end 785 to slide over the bottom end 795 such that when any of the top end's plurality of openings 790 is aligned with the bottom end's more than one opening 800, a push pin 805 may be inserted through the top end and the bottom end to set the vertical height of the first cylindrical collar 780.

Figure 18:
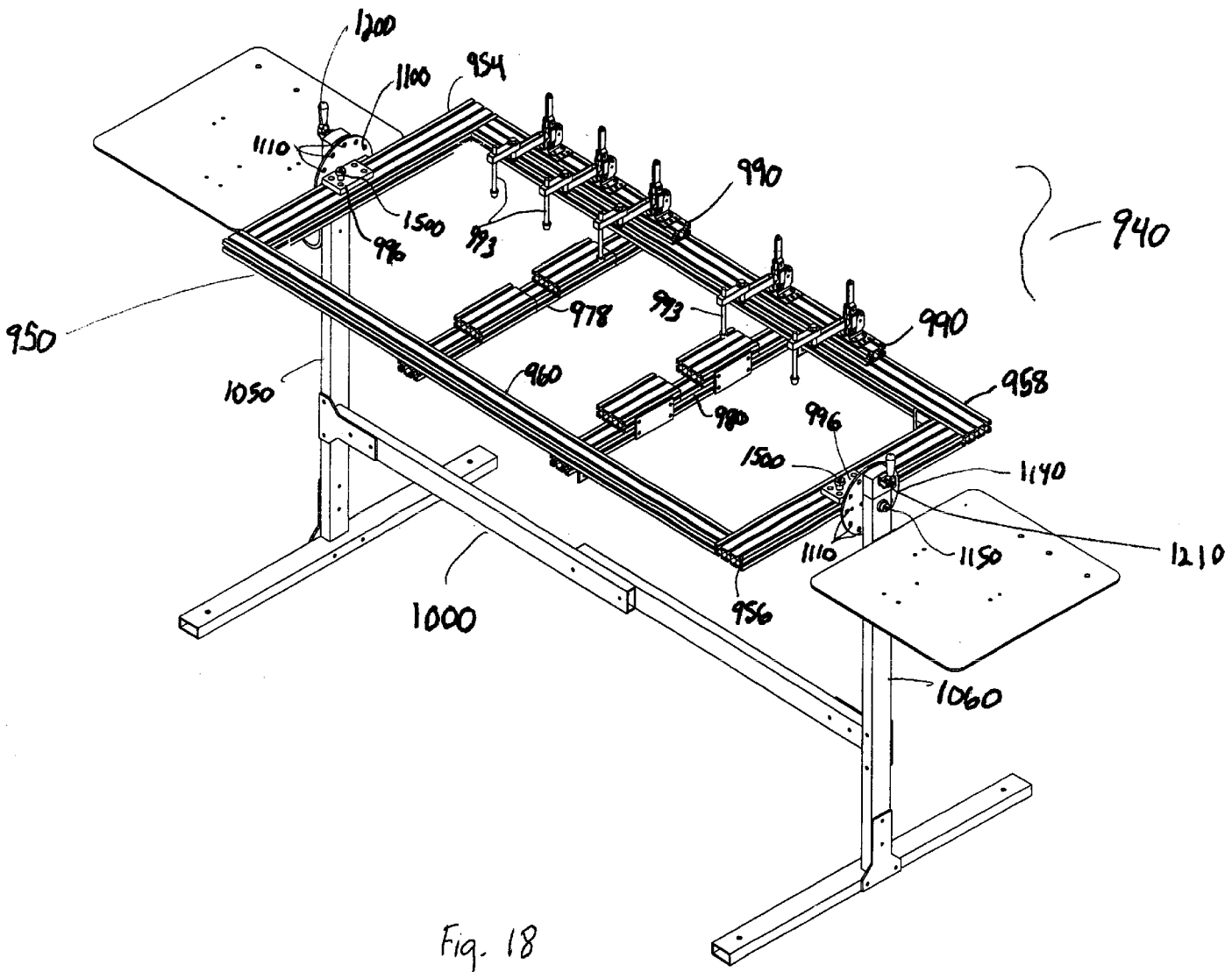
FIG. 18 is a perspective view of an alternate embodiment of the plumbing workstation.

In an improved embodiment of the plumbing workstation, the multiple templates to accommodate various shapes, sizes and numbers of sinks are replaced with a single template arranged and constructed to be adjustable to accommodate the various shapes, sizes and numbers of sinks. Referring to FIG. 18, an improved plumbing workstation 940 is shown. Improved plumbing workstation comprises an adjustable template 950, a frame 1000 upon which the template is mounted for 360° rotation about a horizontal axis, means for locking the template at selected angular positions about the horizontal axis and retaining means for retaining at lease one sink on the template. The locking means and retaining means will be discussed in detail hereinafter.

Figure 19:
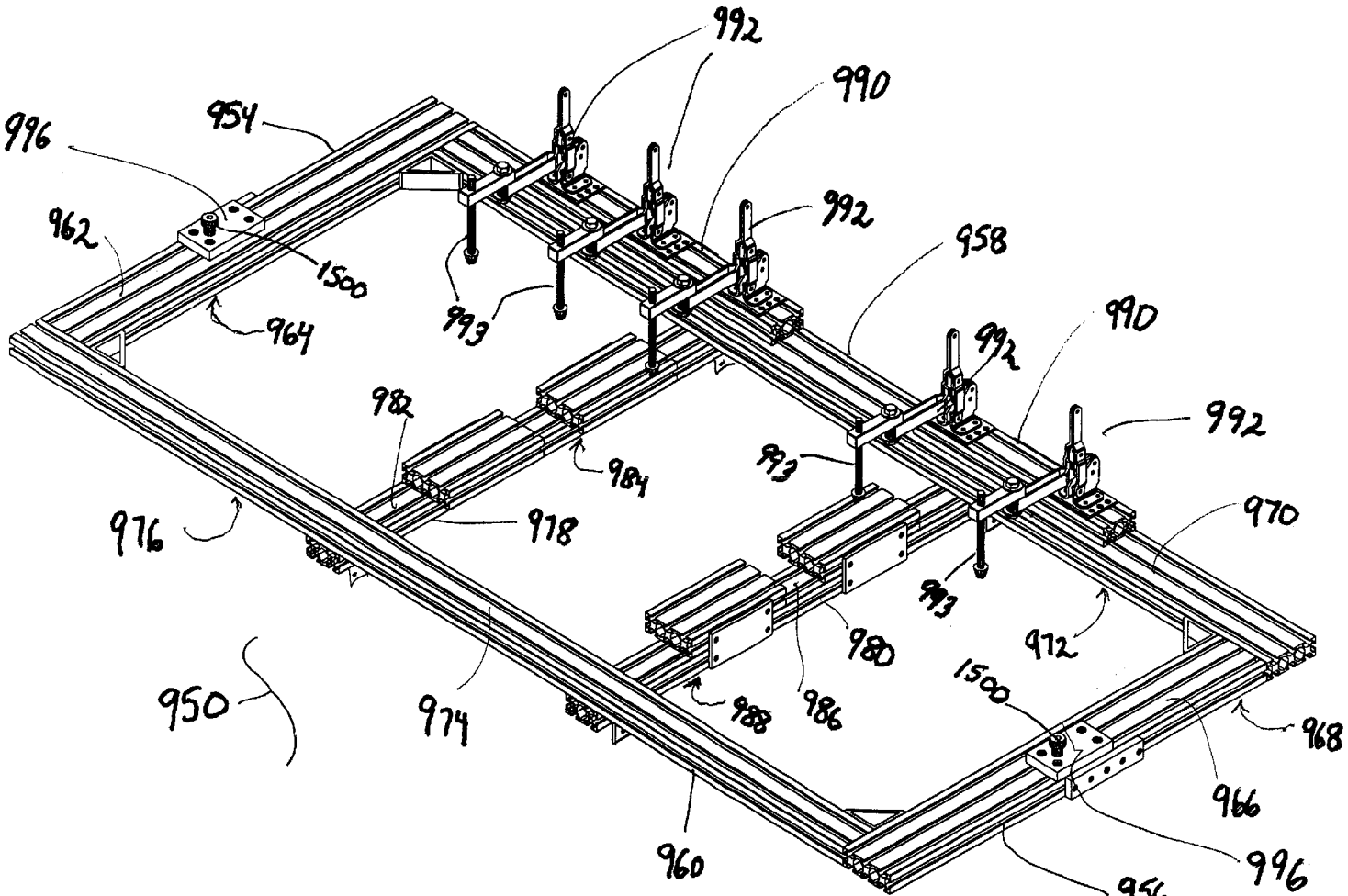
FIG. 19 is a perspective view of the adjustable template.

The adjustable template 950 as shown in detail in FIG. 19, comprises a first end 954, a second end 956 opposite the first end, a first side 958 and a second side 960 opposite the first side. The first end, second end, first side and second side defining a periphery of the adjustable template 950. Each of the first end, second end, first side and, second side include a top 962, 966, 970, 974, and a bottom 964, 968, 972, 976, respectively.

Figure 20:
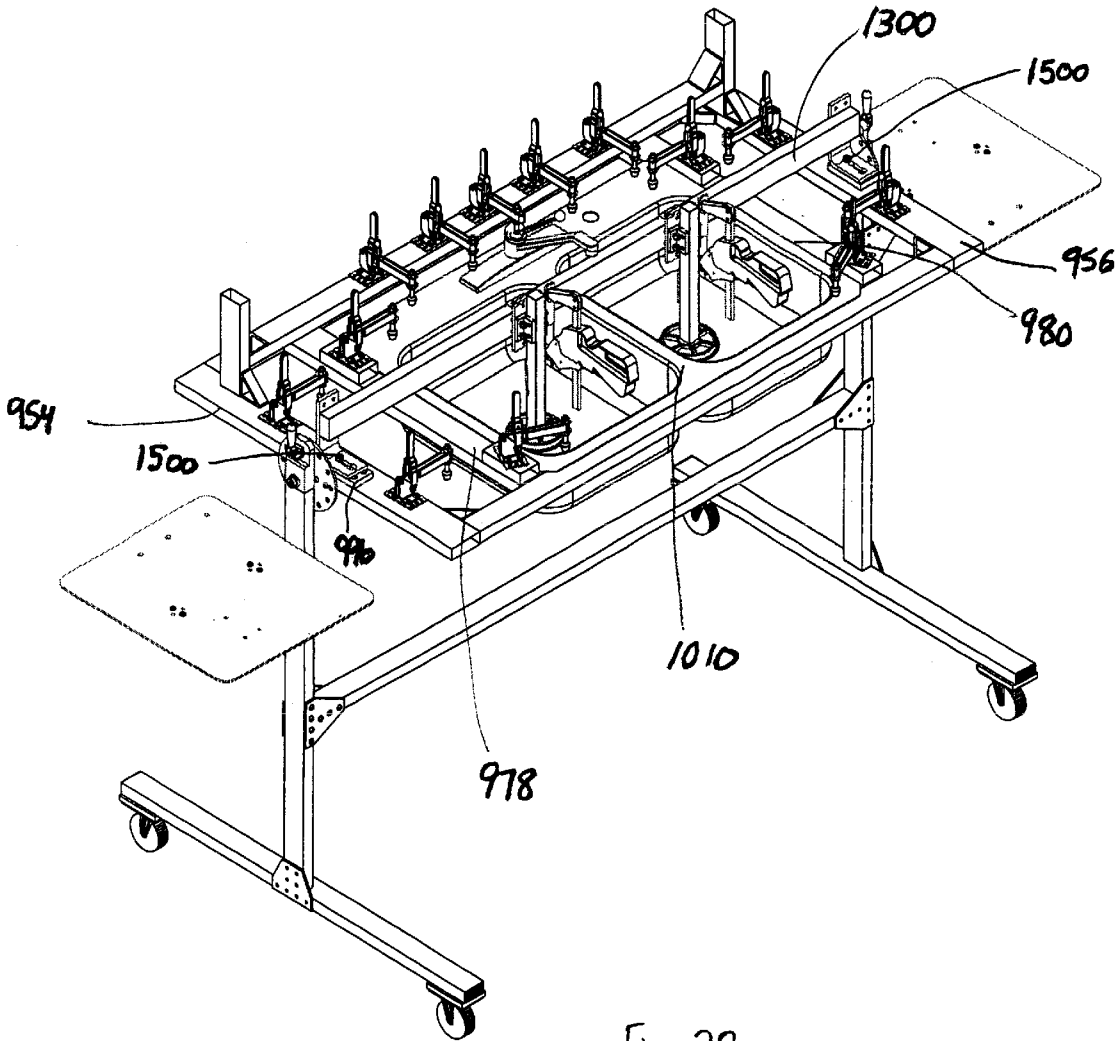
FIG. 20 is a perspective view of an alternative embodiment with a two bowl kitchen sink installed on the plumbing workstation.
Figure 21:
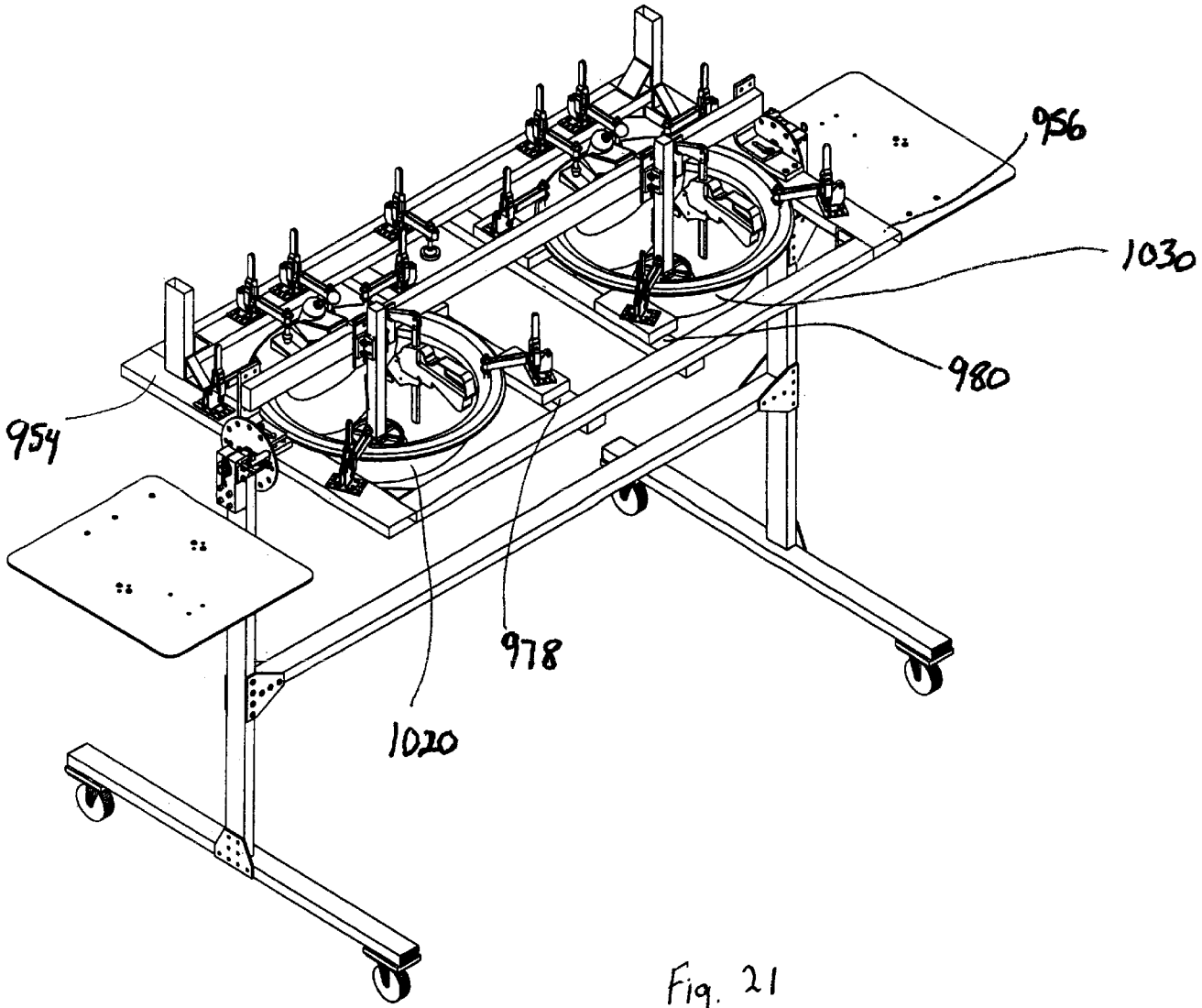
FIG. 21 is a perspective view of an alternate embodiment with two single round bathroom sinks installed on the plumbing workstation.

The adjustable template 950 further comprises a first crossbar 978 and a second crossbar 980. The first crossbar 978 and the second crossbar 980 each include a top 982, 986 and a bottom 984, 988, respectively. The first crossbar 978 and the second crossbar 980 are slideably attached to the first side 958 and second side 960 and are perpendicularly disposed between the first and second sides. Moreover, the first and second crossbars slide independently of one another and are parallel and between the first 954 and second 956 ends to accommodate single sinks or multiple sinks of various shapes and sizes. Referring to FIG. 20, the first crossbar 978 is located toward the first end 954 and the second crossbar 980 is located toward the second end 956 to allow a single unit double kitchen sink 1010 to be mounted on the adjustable template 950 between the first and second crossbars. Another example showing how the same adjustable template can be used to accommodate two separate round bathroom sinks is shown in FIG. 21. As can readily be seen, the first crossbar 978 is located so that a first round bathroom sink 1020 is deposed between the first crossbar 978 and the first end 954. A second bathroom sink 1030 is deposed between the appropriately located second crossbar 980 and the second end 956.

Referring now to FIG. 19, the adjustable template 950 further includes at least one plumbing fixture retainer pad 990 slideably mounted on the top 970 of the first side 958. At least one plumbing fixture retainer 992 is mounted on the at least one plumbing fixture retainer pad 990. As shown in FIG. 18 and FIG. 19, the plumbing fixture retainer 992 may be used in combination with a spring loaded plunger 993 to facilitate temporary securing of plumbing fixtures on the at least one sink. The at least one plumbing fixture retainer 992 can be any common clamping device known in the art. Such clamping devices may include toggle type clamps that can be either mechanical, spring loaded, pneumatic, or hydraulically actuated. FIG. 19, shows a combination toggle clamp and spring loaded plunger assembly used to temporarily retain plumbing fixtures on sinks for installation.

Referring again to FIG. 19, plunger arm assembly support brackets 996 are slideably mounted on the top 962, 966 of the first 954 and second 956 ends of the adjustable template 950. The plunger arm assembly support brackets 996 allow the plunger arm assembly 1300 to be removeably mounted on the adjustable template for temporarily retaining the at least one sink on the adjustable template and for temporarily retaining basket strainers and like drain fixtures on the sink for installation. The at least sink may be also retained on the adjustable template 950 by virtue of clamping devices such as toggle clamps mounted on the adjustable template. As shown in FIGS. 20 and 21 such toggle clamps may be mounted on the first and second ends and the first and second crossbars. Clamping devices may be mechanical, spring loaded, pneumatic, hydraulic or any other clamping device commonly known in the art.

Figure 22:
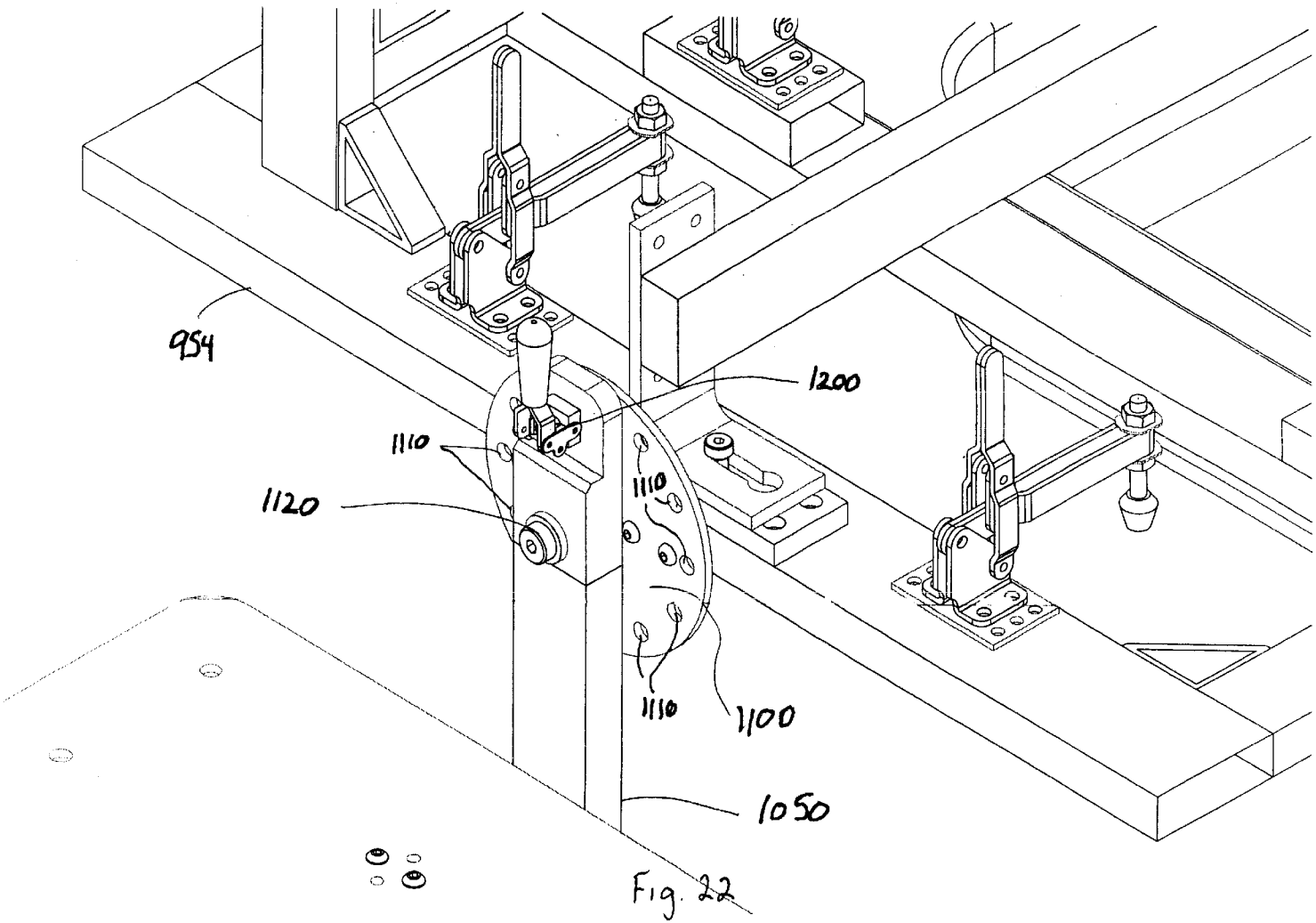
FIG. 22 is a perspective view showing the detail of an alternate rotation means and locking means.

The adjustable template 950 is mounted to frame 1000 to allow for 360 degree rotation about the horizontal axis. Rotation and means for locking the template at selected angular positions may be accomplished as previously discussed or alternatively may be accomplished through the embodiment of the present invention depicted in FIGS. 18–22. Referring to FIGS. 18 and 22, a dial plate 1100 is attached to and centrally located on the first end 954. A first shaft 1120 also centrally located on the first end 954 extends perpendicularly from the first end, through the center of the dial plate 1100, and into and through a hole located near the top of the frames first vertical member 1050, the hole in the first vertical member arranged and constructed for receipt of the first shaft and for allowing retention of the template on the frame and rotation of the template about the horizontal axis. A second shaft 1150 and dial plate 1140 are similarly mounted to the template's second end 956, the second shaft 1150 extending through the second dial plate 1140 and into a hole located in the frames second vertical member 1060, the hole arranged and constructed for receipt of the second shaft and for allowing retention of the template on the frame and rotation of the template about the horizontal axis. Both the first and second vertical member holes may be fitted with a bushing or circular bearing to facilitate rotation of the template. Even though two dial plates are shown, it is anticipated that the present invention may be practiced with only one dial plate. Located around the periphery of the at least one dial plate are a series of holes 1110.

Again, referring to FIGS. 18 and 22, the adjustable template is lockable at selected angular positions about the horizontal axis by virtue of a plunger pin assembly 1200 mounted near the top of the frames first vertical member 1050. The plunger pin assembly 1200 includes a plunger pin that may be extended through the first vertical member and into any one of dial plate holes 1110. Once the plunger pin is extended into a dial plate hole 1110, the template is locked into a corresponding angular position about the horizontal axis. When the plunger pin is withdrawn from dial plate hole 1110, the adjustable template may be rotated whereby the plunger pin may be inserted into another of the dial plate holes 1110 to lock the template at a different angular position about the horizontal axis. A second plunger pin assembly 1210 may be similarly mounted on the frames second vertical member 1060 to operate in conjunction with the second dial plate 1140, thus allowing for the locking of the template at selected angular positions about the horizontal axis to be accomplished utilizing dual plunger pin assembly/dial plate combinations. Note that locking the template at selected angular positions about the horizontal axis may be accomplished with a single plunger pin assembly/dial plate combination located with respect to either the first end 954 or the second end 956.

As previously discussed, sinks are temporarily secured on the template via means such as toggle clamps or the sink retaining bar shown in FIG. 16. The toggle clamps can be either mechanical, spring loaded, pneumatic or hydraulic. Moreover, any type of clamp may be used to retain sinks on the template as is known in the art.

Figure 23:
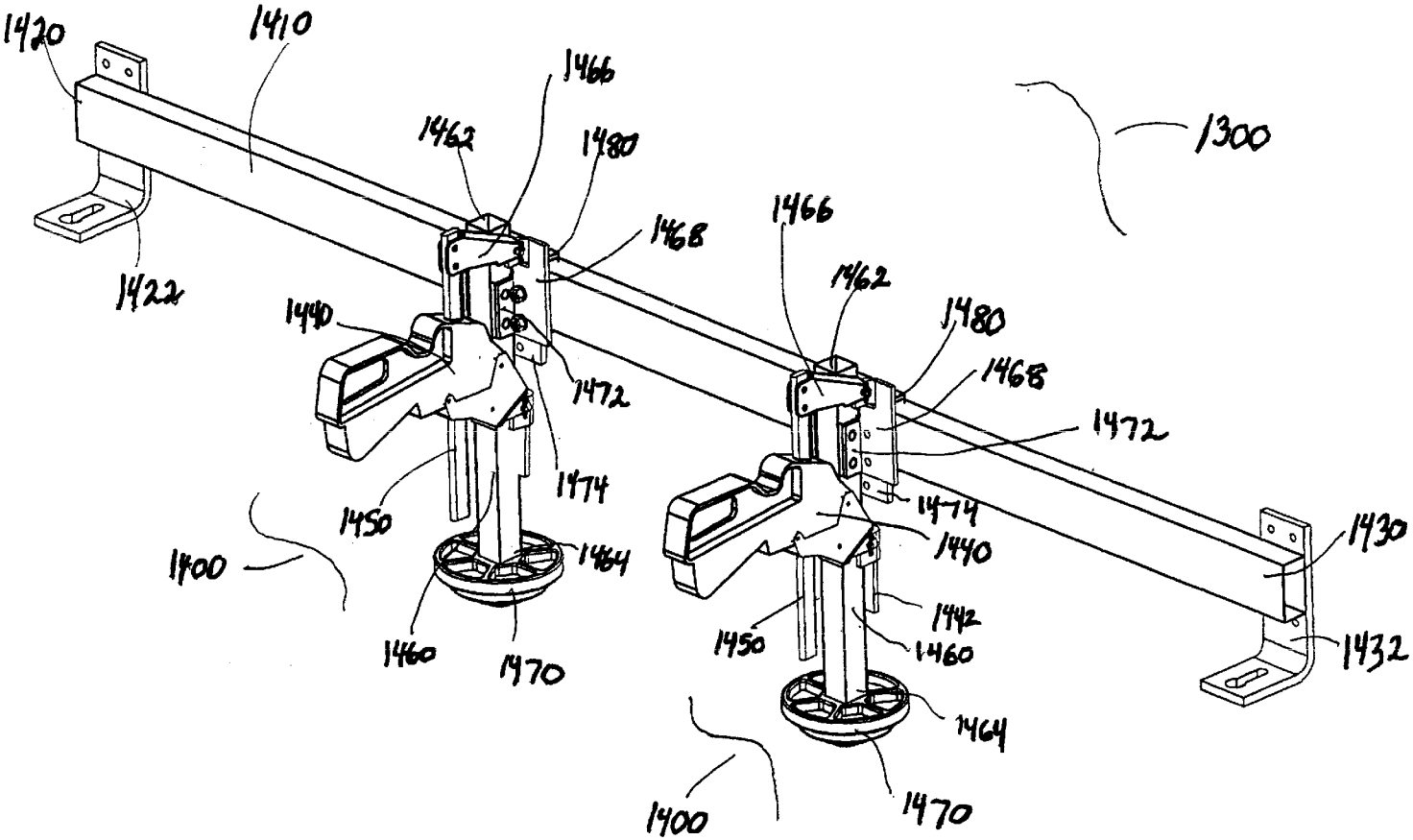
FIG. 23 is a perspective view of the plunger arm assembly.

FIGS. 20, 21 and 23 show an alternative embodiment of the invention where a single plunger arm assembly 1300 serves the dual purpose of temporarily retaining the at least one sink on the adjustable template and also serves as means for retaining sink drain attachments. The plunger arm assembly 1300 holds securely the heads of basket strainers, pop-up assemblies, or garbage disposals (prior to permanent attachment) against the untrimmed sink or lavatory without slippage or undue pressure. The entire assembly easily snaps on and off the adjustable template 950 and adjusts to the particular placement of drain holes in any manufactured sink.

Referring to FIG. 23, the plunger arm assembly 1300 comprises at least one strainer hold down subassembly 1400 a horizontal bar 1410, the horizontal bar having a first end 1420 and a second end 1430, and a first attachment bracket 1422, located at the first end 1420 and a second attachment bracket 1432 located at the second end 1430 of the horizontal bar 1410. FIG. 23 shows two strainer hold down subassemblies as the preferred embodiment. The strainer hold down subassemblies 1400 each comprise a pistol grip 1440, a ratchet bar 1450 in ratchetable contact with the pistol grip, a shaft 1460 having a top end 1462 and a bottom end 1464, a clamp 1466 connected to bracket 1468 and the top end of ratchet bar 1450, a plunger 1470 affixed to the bottom end 1464 of shaft 1460 and a linear bearing 1480 slideably mounted on the horizontal bar 1410 and affixed to connection plate 1474. The strainer hold down subassemblies each further comprise a second linear bearing 1472 slideably mounted on shaft 1460 and connected to bracket 1468. Also, mounted on connection plate 1474 opposite the first linear bearing 1480 is second linear bearing 1472. Thus, as pistol grip 1440 is actuated along ratchet bar 1450, a downward force is transferred to shaft 1460 via bracket 1442 causing shaft 1460 to move in a downward direction through its slideable contact with second linear bearing 1472. Strainer hold down subassemblies 1400 may be located at any position along horizontal bar 1410 between the hold down brackets 1422, 1432 by virtue of first linear bearings 1480.

FIG. 20 shows the plunger arm assembly in use. The plunger arm assembly 1300 is suspended over the at least one sink and the strainer hold down subassembly 1400 is positioned to align the plunger 1470 with the at least one sink's basket strainer (or other fixture such as pop-up assembly or a garbage disposal). Utilizing hold down brackets 1422, 1432, the plunger arm assembly 1300 is mounted on adjustable template 950 via bolts 1500 located on plunger arm assembly support brackets 996 located on the adjustable template's first 954 and second 956 ends. Any adjustments to complete alignment of the plunger 1470 with the basket strainer can now be accomplished. As previously described, shaft 1460 travels downward via actuation of pistol grip 1440. The plunger 1470 is located at the bottom end of shaft 1460. Actuating the pistol grip 1440 along ratchet bar 1450 allows shaft 1460 and consequently plunger 1470 to be ratcheted in a direction perpendicular to the installed basket strainer. Thus, plunger 1470 can be ratcheted into contact with the basket strainer or other sink drain attachment to temporarily secure the basket strainer or other sink drain attachment to the at least one sink to allow a worker to complete permanent installation of a basket strainer onto the at least one sink. Once the basket strainer is installed, and assuming all other sink fixtures are installed, the plunger arm assembly 1300 may be removed by actuating the pistol grip's release and sliding shaft 1460 and thus plunger 1470 away from the installed sink drain attachment and disconnecting the plunger arm assembly from the plunger arm assembly support brackets 996.

Thus, in use, an improved plumbing workstation 940 is provided. Adjustable template 950 is typically located at a generally horizontal angular position about the horizontal axis. Adjustable template 950 can now be configured by locating first crossbar 978 and second crossbar 980 to support the at least one sink. FIG. 20 shows a single twin bowl kitchen sink 1010, while FIG. 21 shows the adjustable template supporting two separate round bathroom lavatories 1020, 1030. Once the template is configured and the at least one sink is installed on the template, the at least one sink may be retained on the template by using clamps such as toggle clamps mounted on the template's first end 954, second end 956, and/or first crossbar 978 and second crossbar 980. Alternately, the at least one sink may be retained by the plunger arm assembly 1300 as previously discussed. Note, the plunger arm assembly 1300 also temporarily secures sink drain attachments as previously discussed.

Next, at least one plumbing fixture, such as a faucet, is placed on the at least one sink. The at least one plumbing fixture retainer pad 990 is slid along first side 958 to align plumbing fixture retainers 992, 992/993 to temporarily secure the at least one plumbing fixture on the at least one sink. Once the at least one plumbing fixture is temporarily retained, the template may be rotated to a second angular position about the horizontal axis and locked into place using plunger pin assemblies 1200, 1210. Final installation of plumbing fixtures and drain attachments can now be performed. Once fixtures and drain attachments are permanently installed on the at least one sink, the template is rotated back to a generally horizontal position, the at least one plumbing fixture retainers and the at lease one sink retainer are disengaged and the fully-assembled sink is lifted from the adjustable template thereby removing it from the improved plumbing workstation. The fully-assembled at least one sink may now be permanently installed in its final location.

As can be readily seen, the present invention eliminates the problems associated with the traditional method of installing sinks and sink fixtures. A worker is no longer required to crawl under a counter and assume an awkward and muscle straining position to install plumbing fixtures on sinks. Thus, the plumbing workstation is especially effective in eliminating muscle strains and corresponding lost time incidents associated with back strain occurring on jobs where many sinks must be installed. Further, the time to install a sink and sink fixtures can be drastically reduced. This cost savings becomes particularly significant on multi-unit plumbing jobs as in the case of apartment buildings and hotels.

Although other advantages may be found and realized and various modifications may be suggested by those versed in the art, it is understood that the present invention is not to be limited to the details given above, but rather may be modified within the scope of the appended claims.

I claim:

1. An improved plumbing workstation for use by a worker to install at least one plumbing fixture onto at least one sink, comprising:

a. a template for temporarily supporting the at least one sink, the template being adjustable to accommodate at least one size and at least one shape of the at least one sink;

b. a frame upon which the template is mounted for 360° rotation about a horizontal axis;

c. at lease one means for locking the template at selected angular positions about the horizontal axis; and d. retaining means for retaining the at least one sink on the template and for retaining at least one sink drain attachment on the at least one sink such that when the at least one sink is secured on the template, the template is at a generally horizontal first angular position, and when the template is rotated about the horizontal axis from the first angular position to a second angular position, the at least one sink is retained on the template to facilitate installation of the at least one plumbing fixture and the at least one sink drain attachment on the at least one sink.

2. The improved plumbing workstation of claim 1, further comprising at least one means for temporarily retaining the at least one plumbing fixture, the at least one plumbing fixture retaining means being mounted on the template such that when the template is rotated to the second angular position, the at least one plumbing fixture retaining means holds the at least one plumbing fixture in place while the at least one plumbing fixture is installed.

3. The improved plumbing workstation of claim 1, wherein the frame includes means for vertically adjusting the position of the horizontal axis.

4. The improved plumbing workstation of claim 1, wherein the frame includes means for collapsing the frame.

5. An improved plumbing workstation for use by a worker to install at least one plumbing fixture onto at least one sink, comprising:

a. a template for temporarily supporting the at least one sink, the template being adjustable to accommodate at least one size and at least one shape of the at least one sink;

b. a frame upon which the template is mounted for 360° rotation about a horizontal axis;

c. at lease one means for locking the template at selected angular positions about the horizontal axis; and d. at least one means for temporarily securing the at least one sink on the template such that when the at least one sink is secured on the template the template is at a generally horizontal first angular position, and when the template is rotated about the horizontal axis from the first angular position to a second angular position, the at least one sink is retained on the template to facilitate installation of the at least one plumbing fixture on the at least one sink.

6. The plumbing workstation of claim 5, further comprising at least one means for retaining the at least one plumbing fixture, the at least one plumbing fixture retaining means being mounted on the template such that when the template is rotated to the second angular position, the at least one plumbing fixture retaining means holds the at least one plumbing fixture in place while the at least one plumbing fixture is installed.

7. The plumbing workstation of claim 5, further comprising at least one means for retaining sink drain attachments on the at least one sink, the at least one sink drain attachment retaining means being mounted on the template such that when the template is rotated to the second angular position, the at least one sink drain attachment retaining means holds at least one sink drain attachment in place on the at least one sink while the at least one sink drain attachment is installed.

8. The plumbing workstation of claim 5, wherein the frame includes means for vertically adjusting the position of the horizontal axis.

9. The plumbing workstation of claim 5, wherein the frame includes means for collapsing the frame.

10. An improved plumbing workstation for use by a worker to install at least one plumbing fixture on at least one sink, comprising:

a. A template for temporarily supporting the at least one sink, the template comprising a first end having a top, a bottom and an outside edge, a second end opposite the first end, the second end having a top, a bottom and an outside edge, a first side having a top and a bottom, a second side opposite the first side, the second side having a top and a bottom, the first end, second end, first side and second side defining a periphery of the template, a first dial plate centrally mounted on the first ends outside edge, the dial plate comprising a circular periphery and a plurality of holes located along the circular periphery, a first shaft centrally located on the first ends outside edge, the first shaft extending perpendicularly from the first ends outside edge and through the center of the dial plate, a second shaft centrally located on the second ends outside edge, the second shaft extending perpendicularly from the second ends outside edge, a first crossbar having a top and a bottom, a second crossbar having a top and a bottom, the first crossbar and the second crossbar being slidably attached to the first side and the second side, the first crossbar and the second crossbar being perpendicularly disposed between the first side and the second side, the first crossbar and the second crossbar are arranged and constructed to slide independently along the first side and the second side while remaining parallel to the first end and the second end, such that the template is adjustable to accommodate at least one size and at least one shape of the at least one sink;

b. a frame upon which the template is mounted for up to 360° rotation about a horizontal axis;

c. at least one releasable lock for locking the template at selected angular positions about the horizontal axis, the releasable lock being mounted on the frame; and d. at least one sink retainer for securing the at least one sink on the template such that when the template is at a generally horizontal first angular position, the at least one sink can be inserted and secured on the template, and when the template is rotated about the horizontal axis from the first angular position to a second angular position, the at least one sink is retained on the template for installing the at least one plumbing fixture.

11. The improved plumbing workstation of claim 10 wherein the template further comprises a second dial plate centrally mounted on the second ends outside edge, the second dial plate comprising a circular periphery and a plurality of holes located along the second dial plates circular periphery, the second shaft passing through the center of the second dial plate.

12. The improved plumbing workstation of claim 10 wherein the at least one sink retainer comprises at least one toggle clamp.

13. The improved plumbing workstation of claim 10, further comprising at least one plumbing fixture retainer mounted on the template for temporarily securing the at least one plumbing fixture onto the at least one sink.

14. The improved plumbing workstation of claim 13, wherein the at least one sink retainer comprises a plunger arm assembly, the plunger arm assembly also arranged and constructed to temporarily retain at least one sink drain attachment, the plunger arm assembly comprising a horizontal bar having a first end and a second end, a first attachment bracket mounted onto the horizontal bar's first end, a second attachment bracket mounted on the horizontal bar's second end, at least one strainer hold-down subassembly slidably mounted on the horizontal bar between the first and second attachment brackets, such that when the plunger arm assembly is mounted onto the template's first and second plunger arm assembly support brackets the at least one sink is temporarily retained on the template and the at least one sink drain attachment is temporarily retained on the at least one sink.

15. The method of claim 15, further comprising locking the template into a horizontal position on the frame with at least one releasable lock.

16. The improved plumbing workstation of claim 10, wherein the template further comprises a first punger arm assembly support bracket slidably mounted on the top of the template's first end, and a second plunger arm assembly support bracket slidably mounted on the top of the template's second end.

17. A method for installing at least one plumbing fixture on at least one sink using a plumbing workstation, comprising the steps:

a. providing a template for temporarily supporting the at least one sink, the template being adjustable to accommodate at least one size and at least one shape of the at least one sink;

b. mounting the template onto a frame such that the template is capable of 360° rotation about a horizontal axis, the template being at a generally horizontal first angular position;

c. placing at least one sink into the template;

d. securing the at least one sink into the template with at least one sink retainer;

e. retaining temporarily at least one plumbing fixture onto the at least one sink with at least one plumbing fixture retainer;

f. rotating the template about the horizontal axis to a second angular position;

g. locking the template into the second angular position with at least one releasable lock;

h. installing the at least one plumbing fixture onto the at least one sink; and i. removing at least one sink from the template.

18. In combination, at least one sink and a plumbing workstation for use by a worker for installing at least one plumbing fixture on the at least one sink, the plumbing workstation comprising;

a. a template for temporarily supporting the at least one sink, the template comprising a first end having a top and a bottom, a second end opposite the first end, the second end having a top and a bottom, a first side having a top and a bottom, a second side opposite the first side, the second side having a top and a bottom, the first end, second end, first side and second side defining a periphery of the template, a first dial plate centrally mounted on the first end's outside edge, the dial plate comprising a circular periphery and a plurality of holes located along the circular periphery, a first shaft centrally located on the first end's outside edge, the first shaft extending perpendicularly from the first end's outside edge and through the center of the dial plate, a second shaft centrally located on the second end's outside edge, the second shaft extending perpendicularly from the second end's outside edge, a first crossbar having a top and a bottom, a second crossbar having a top and a bottom, the first crossbar and the second crossbar being slidably attached to the first side and the second side, the first crossbar and the second crossbar being perpendicularly disposed between the first side and the second side, the first crossbar and the second crossbar are arranged and constructed to slide independently along the first side and the second side while remaining parallel to the first end and the second end, such that the template is adjustable to accommodate at least one size and at least one shape of the at least one sink;

b. a frame upon which the template is mounted for 360° rotation about a horizontal axis;

c. at least one means for locking the template at selected angular positions about the horizontal axis; and d. at least one means for temporarily securing the at least one sink on the template such that when the at least one sink is secured on the template, the template is at a generally horizontal first angular position, and when the template is rotated about the horizontal axis from the first angular position to a second angular position, the at least one sink is retained on the template to facilitate installation of at least one plumbing fixture on the at least one sink.

19. The improved plumbing workstation of claim 18 wherein the template further comprises a second dial plate centrally mounted on the second ends outside edge, the second dial plate comprising a circular periphery and a plurality of holes located along the second dial plates circular periphery, the second shaft passing through the center of the second dial plate.

20. The combination of claim 18, wherein the at least one sink is supported in a generally horizontal position when the template is at the first angular position and the template is rotatable over 360° about the horizontal axis.

* * * * *